US007515866B2

(12) United States Patent
Togashi et al.

(10) Patent No.: US 7,515,866 B2
(45) Date of Patent: Apr. 7, 2009

(54) IMAGE FORMING APPARATUS

(75) Inventors: Toshifumi Togashi, Kanagawa (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 391 days.

(21) Appl. No.: 11/294,654

(22) Filed: Dec. 5, 2005

(65) Prior Publication Data

US 2006/0127149 A1 Jun. 15, 2006

(30) Foreign Application Priority Data

Dec. 14, 2004 (JP) ..... 2004-361906
Dec. 14, 2004 (JP) ..... 2004-361918

(51) Int. Cl.
*G03G 15/00* (2006.01)

(52) U.S. Cl. ..... 399/381; 399/361; 399/392; 399/393; 399/401; 399/405; 271/3.14

(58) Field of Classification Search ..... 399/361, 399/363, 364, 381, 388, 391, 392, 393, 396, 399/397, 401, 405; 271/3.14, 3.17, 8.1, 9.01, 271/9.09, 104, 121, 256–270, 145, 278, 176; 374/104

See application file for complete search history.

(56) References Cited

U.S. PATENT DOCUMENTS 4,579,328 A * 4/1986 Hagihara et al. ..... 271/9.08
5,216,472 A * 6/1993 Muto et al. ..... 399/392

FOREIGN PATENT DOCUMENTS

| | | | |
|---|---|---|---|
| JP | 60063557 A | * | 4/1985 |
| JP | 61178363 A | * | 8/1986 |
| JP | 63106270 A | * | 5/1988 |
| JP | 63-173248 | | 11/1988 |
| JP | 02286546 A | * | 11/1990 |
| JP | 3-138256 | | 6/1991 |
| JP | 6-64792 | | 3/1994 |
| JP | 08091643 A | * | 4/1996 |
| JP | 9-235029 | | 9/1997 |
| JP | 2698699 | | 9/1997 |
| JP | 2702533 | | 10/1997 |
| JP | 10-17179 | | 1/1998 |
| JP | 3060361 | | 6/1999 |
| JP | 2000-211768 | | 8/2000 |
| JP | 3516733 | | 1/2004 |
| JP | 2004299892 A | * | 10/2004 |

* cited by examiner

*Primary Examiner*—Jill E Culler
*Assistant Examiner*—'Wyn' Q Ha
(74) *Attorney, Agent, or Firm*—Cooper & Dunham, LLP

(57) ABSTRACT

An image forming apparatus is disclosed that includes an image forming part configured to form an image on a recording medium, a feed part for feeding the recording medium, a manual feed part for manually feeding the recording medium, and a shutter member configured to open and close a manual feed opening from the manual feed part. The shutter member is provided so as to be swingable.

13 Claims, 21 Drawing Sheets

IMAGE FORMING APPARATUS

BACKGROUND

1. Technical Field

This disclosure relates generally to image forming apparatuses, and more particularly to an image forming apparatus having a manual paper feed part.

2. Description of the Related Art

Known as image forming apparatuses such as printers, facsimile machines, copiers, and printer/facsimile machine/copier multifunction apparatuses are, for example, an inkjet recording apparatus performing image formation by attaching liquid droplets of recording liquid to a recording target medium (a medium on which recording is to be performed) while conveying the medium, using a recording head (image forming part) formed of a liquid ejection head ejecting the liquid droplets of the recording liquid; and an electrophotographic image forming apparatus performing image formation by electrophotography.

In the following description, synonyms of "image formation" may include "recording" and "printing." Further, "liquid droplet" may also be referred to as "ink droplet." Further, "recording target medium" may also be referred to as, but not limited in material to, "paper," and synonyms of "recording target medium" may include "recording medium" and "transfer material."

As shown in, for example, Japanese Laid-Open Patent Application Nos. 3-138256 (Document 1), 9-235029 (Document 2), and 10-17179 (Document 3), the image forming apparatus has multiple paper feed parts in order to feed paper for image formation to the main body of the apparatus, such as a paper feed tray on which multiple sheets of paper are placeable, a paper feed cassette capable of containing a large amount of paper, and one or more types of manual paper feed trays (parts) for allowing a user to directly feed paper manually, for example, one capable of receiving multiple sheets of paper and another capable of receiving a single sheet of paper.

Further, as shown in Japanese Patent No. 2698699 (Document 4) and Japanese Laid-Open Patent Application No. 2000-211768 (Document 5), some image forming apparatuses allow paper to be fed from a paper output tray, and output the paper again onto the paper output tray after forming an image thereon, thereby omitting a manual paper feed part.

Further, Japanese Utility Model Registration No. 3060361 (Document 6) discloses an image forming apparatus that feeds paper fed from a manual paper feed opening to a printing part, and after printing, conveys the paper again to the manual paper feed opening and outputs the paper.

Further, Japanese Examined Utility Model Application Publication No. 7-3403 (Document 7) discloses an image forming apparatus including a retractable manual paper feed table and a blocking member that moves up and down in conjunction with the opening and closing of the manual paper feed table so as to move down when the manual paper feed table is opened to a manual paper feed position, thereby putting a manual feed detection part in or out of operation. When paper is fed to the manual paper feed table at the manual paper feed position, a blocking member for paper detection leaves a paper detection part. As a result, performability of paper feeding is detected and displayed.

Further, Japanese Laid-Open Patent Application No. 6-64792 (Document 8) discloses an image forming apparatus that performs registration by forming a loop in paper and feeds the paper to an image forming part through a registration roller device.

Further, Japanese Patent No. 2702533 (Document 9) discloses an image forming apparatus that employs switch-back printing. According to this apparatus, paper having printing on one side thereof is turned upside down and fed so that printing is performed on the other side of the paper. After having both sides subjected to printing, the paper is output onto a paper output tray.

Further, Japanese Laid-Open Patent Application No. 8-110660 (Document 10) discloses an image forming apparatus reduced in size by disposing a paper feed cassette below a reading part.

However, for example, in the image forming apparatuses disclosed in Documents 1 and 2 described above, when either manual paper feed tray is ready to feed paper manually, manual paper feeding is performable. Accordingly, if manual paper feeding is performed while paper on which image formation is being performed is remaining in the apparatus, multiple sheets of paper may be conveyed one over another, so that a paper jam may be caused. Likewise, in the image forming apparatus shown in Document 4, in which the paper output tray is also used as a manual feed tray, a paper jam may also occur if paper on which an image has been formed is output from inside the apparatus when paper is manually fed from the paper output tray.

Further, image forming apparatuses such as inkjet recording apparatuses employ paper output methods such as straight paper output and face-down paper output. According to straight paper output, paper is fed straight, and after an image is formed thereon, the paper is conveyed straight to be output with its print side (on which the image is formed) facing upward. According to face-down output, paper is reversed (turned upside down) after an image is formed thereon, and is output with its print side facing downward. In the image forming apparatus performing straight paper output, the entire apparatus including output paper takes up a large space. On the other hand, in the image forming apparatus performing reverse (face-down) paper output, in the case of performing printing on paper on which ink dries less easily, such as an OHP sheet, the print side of the paper may rub on a guide member at the time of reversal of the paper, thus resulting in a degraded image. Further, in the case of using thick paper, possible failure in paper reversal may cause a paper jam.

Accordingly, it is preferable to provide, apart from a regular paper feed tray and manual paper feed part, a single-sheet manual paper feed part for straight manual paper feeding, and it is preferable to provide a straight paper output tray for straight paper conveyance and output. In this case, the single-sheet manual paper feed part and the straight paper output tray may be provided so as to be retractable relative to the apparatus main body in order to prevent an increase in the space taken up by the apparatus.

In the case of thus providing a single-sheet manual paper feed part for manually feeding a single sheet of paper, if the same configuration as the image forming apparatus shown in Document 6, where the manual paper feed opening is also used as a paper output opening, or the image forming apparatuses shown in Documents 4 and 5, where the paper output tray is also used as a manual feed tray, is employed, a paper jam may occur if paper is fed from the manual paper feed opening or the paper output tray with paper remaining in the apparatus.

Further, in the case of providing a straight paper output tray, if the straight paper output tray is left unable to output paper, straight paper output cannot be performed when a single sheet of paper is manually fed, so that a paper jam may also occur. Further, if it is so configured as to prevent paper from being fed in such a case, a user may not know the reason for no paper feeding, and may mistake it for failure. Thus, the user interface may be degraded.

SUMMARY

In an aspect of this disclosure, there is provided an image forming apparatus capable of performing stable manual paper feeding without a paper jam.

In another aspect of this disclosure, there is provided an image forming apparatus capable of performing stable single-sheet manual paper feeding without a paper jam.

In an exemplary embodiment of this disclosure, there is provided an image forming apparatus including an image forming part configured to form an image on a recording medium, a feed part for feeding the recording medium, a manual feed part for manually feeding the recording medium, and a shutter member configured to open and close a manual feed opening from the manual feed part, wherein the shutter member is provided so as to be swingable.

According to one embodiment of the present invention, an image forming apparatus has a shutter member that opens and closes the feed opening of a manual feed part. Accordingly, even when the manual feed part is ready to perform manual feeding, if a recording medium is remaining inside the apparatus, manual feeding of a recording medium from the manual feed part is prevented by keeping the shutter member closed, so that it is possible to prevent occurrence of a jam.

In another exemplary embodiment of this disclosure, there is provided an image forming apparatus including a single-sheet manual feed part for manually feeding a recording medium one sheet at a time, and a part configured to prevent, when the recording medium is remaining inside a main body of the image forming apparatus, the feeding from the single-sheet manual feed part from being started until output of the recording medium remaining inside the main body is completed.

According to one embodiment of the present invention, an image forming apparatus includes a part that prevents, when a recording medium is remaining inside the apparatus main body, feeding from a single-sheet manual feed part from being started until output of the recording medium remaining inside the main body is completed. As a result, single-sheet manual feeding is not performed while the recording medium is remaining inside the apparatus main body, so that no jam is caused. Accordingly, it is possible to perform stable single-sheet manual feeding.

In another exemplary embodiment of this disclosure, there is provided an image forming apparatus including a single-sheet manual feed part for manually feeding a recording medium one sheet at a time, a straight output tray onto which the recording medium fed from the single-sheet manual feed part is output straight, the straight output tray being provided so as to be openable and closable, and a part configured to output, in a case of performing the feeding from the single-sheet manual feed part, information encouraging an operation to open the straight output tray to a position where the recording medium fed from the single-sheet manual feed part is outputtable onto the straight output tray.

According to one embodiment of the present invention, an image forming apparatus includes an openable and closable straight output tray onto which a recording medium fed from a single-sheet manual feed part is output straight, and a part that outputs, in a case of performing feeding from the single-sheet manual feed part, information encouraging an operation to open the straight output tray to a position where the recording medium fed from the single-sheet manual feed part is outputtable onto the straight output tray. As a result, single-sheet manual feeding is not performed while outputting onto the straight output tray is not performable, so that no jam is caused. Accordingly, it is possible to perform stable single-sheet manual feeding.

In another exemplary embodiment of this disclosure, there is provided an image forming apparatus including a single-sheet manual feed part for manually feeding a recording medium one sheet at a time, wherein the recording medium is fed from the single-sheet manual feed part, and is output onto the single-sheet manual feed part after an image is formed on the recording medium, and a feed speed at a time of starting to feed the recording medium from the single-sheet manual feed part and a feed speed at a time of outputting the recording medium onto the single-sheet manual feed part are lower than a feed speed at a time of forming the image on the recording medium.

According to one embodiment of the present invention, in an image forming apparatus, when a recording medium is fed from a single-sheet manual feed part, and is output onto the single-sheet manual feed part after an image is formed on the recording medium, a feed speed at the time of starting to feed the recording medium from the single-sheet manual feed part and a feed speed at the time of outputting the recording medium onto the single-sheet manual feed part are lower than a feed speed at the time of forming the image on the recording medium. Accordingly, it is possible to prevent the recording medium from flying out of the single-sheet manual feed part when the recording medium is output.

In another exemplary embodiment of this disclosure, there is provided an image forming apparatus including a single-sheet manual feed part for manually feeding a recording medium one sheet at a time and a straight output tray onto which the recording medium fed from the single-sheet manual feed part is output straight, the straight output tray being provided so as to be openable and closable, wherein when the recording medium is fed from the single-sheet manual feed part and an image is formed on the recording medium fed from the single-sheet manual feed part, the recording medium is output onto the straight output tray when the straight output tray is in a position where the recording medium fed from the single-sheet manual feed part is outputtable onto the straight output tray, and the recording medium is output onto the single-sheet manual feed part when the straight output tray is in a position where the recording medium fed from the single-sheet manual feed part is prevented form being output onto the straight output tray.

According to one embodiment of the present invention, an image forming apparatus includes an openable and closable straight output tray onto which a recording medium fed from a single-sheet manual feed part is output straight. When the recording medium is fed from the single-sheet manual feed part and an image is formed on the recording medium fed from the single-sheet manual feed part, the recording medium is output onto the straight output tray when the straight output tray is in a position where the recording medium fed from the single-sheet manual feed part is outputtable onto the straight output tray, and the recording medium is output onto the single-sheet manual feed part when the straight output tray is in a position where the recording medium fed from the single-sheet manual feed part cannot be output onto the straight output tray. As a result, single-sheet manual feeding is not performed while outputting onto the straight output tray is not performable, so that no jam is caused. Accordingly, it is possible to perform stable single-sheet manual feeding, and it is also possible to perform single-sheet manual feeding quickly.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

Figure 1:
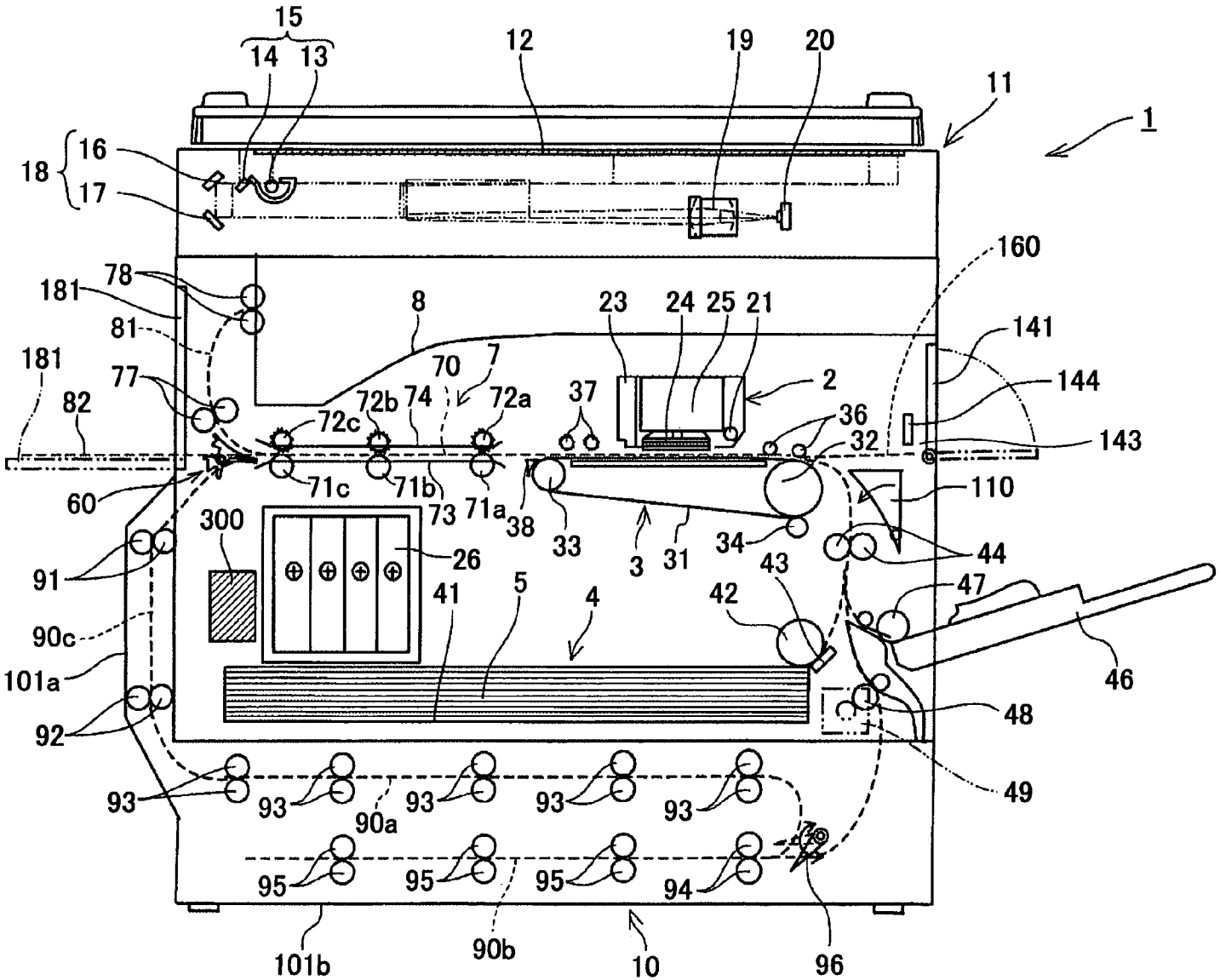
FIG. 1 is a schematic diagram showing an image forming apparatus according to a first embodiment of the present invention.
Figure 2:
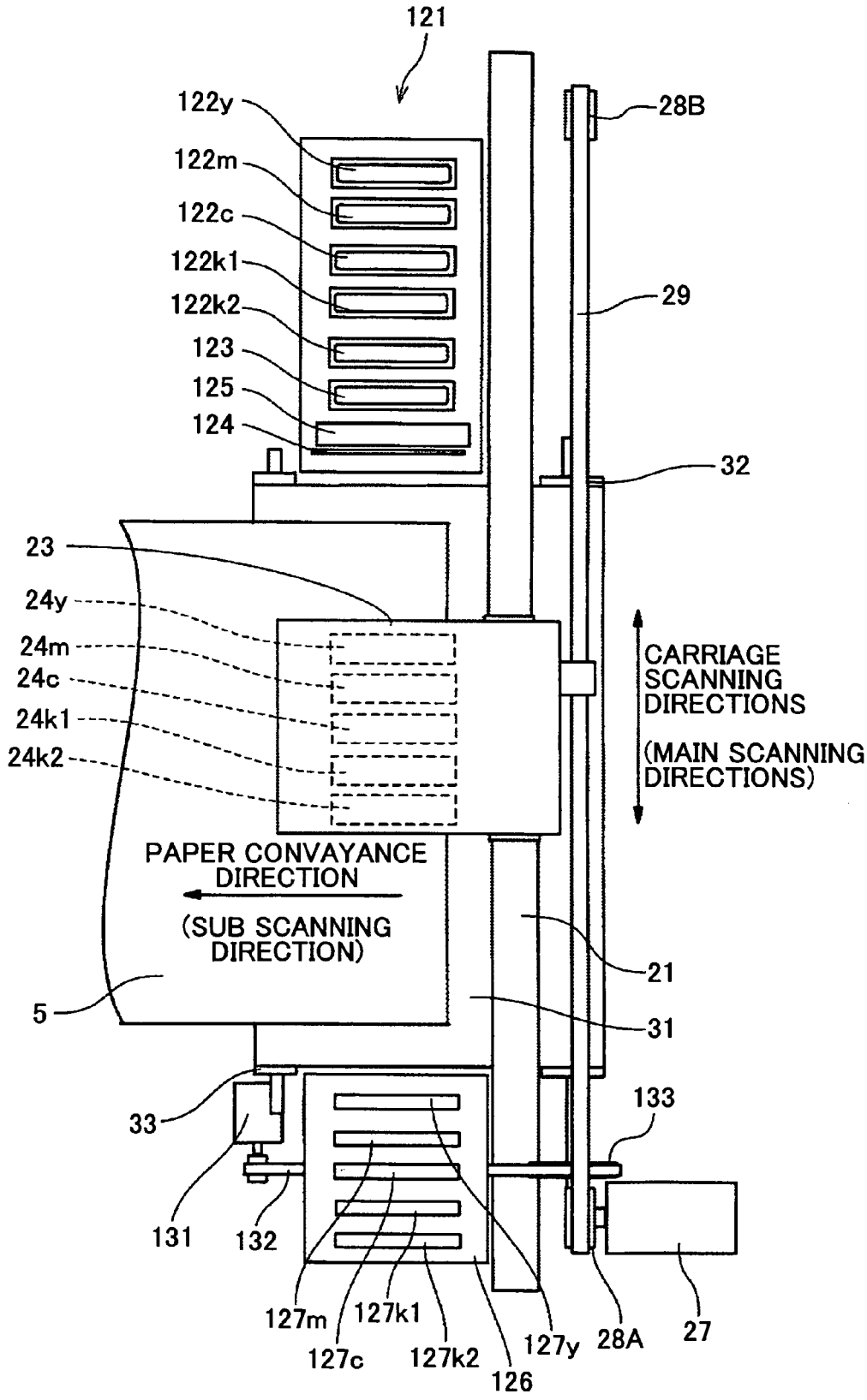
FIGS. 2 and 3 are a plan view and a side view, respectively, of an image forming part and a sub scanning conveyance part of the image forming apparatus according to the first embodiment of the present invention.
Figure 3:
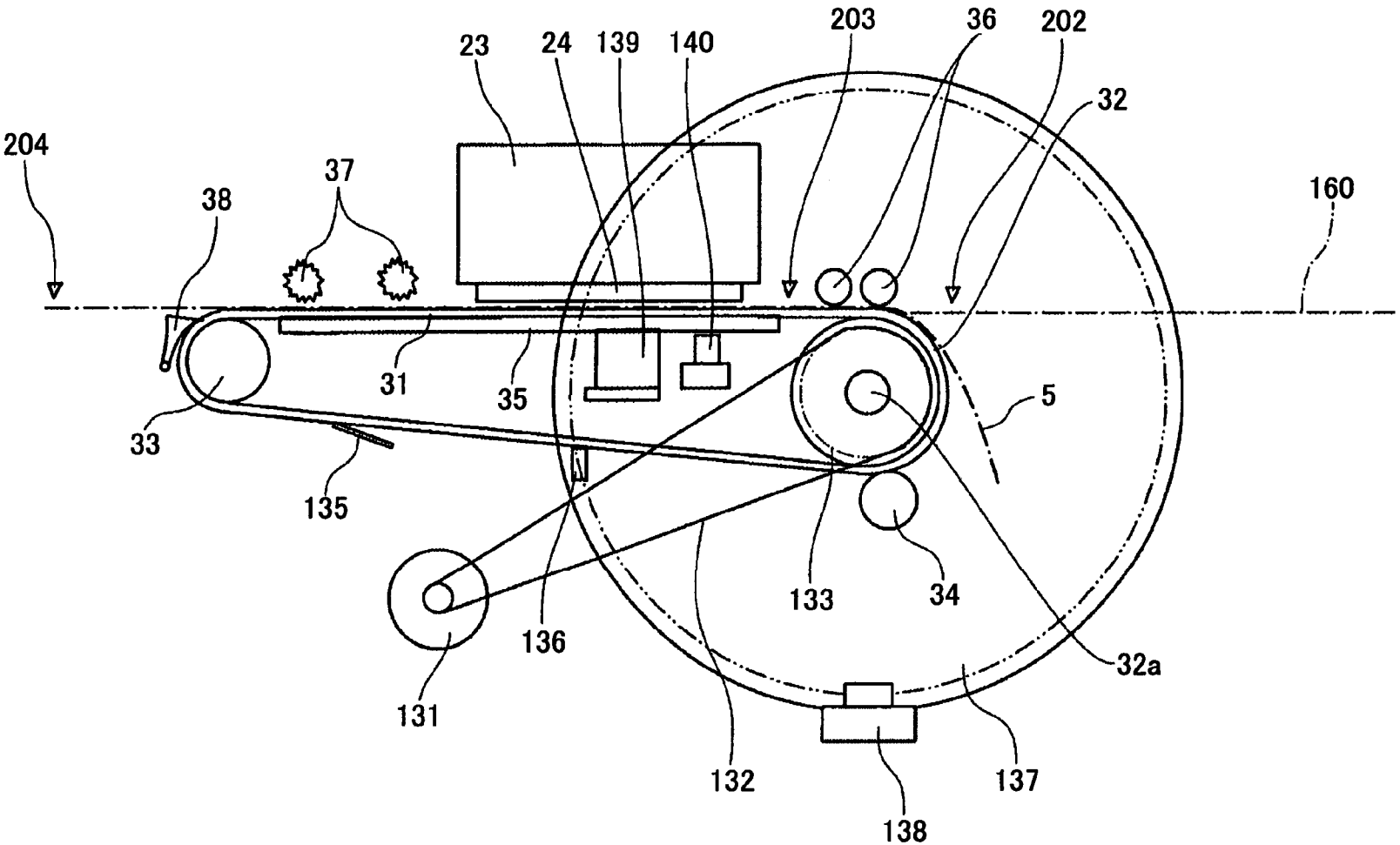
Figure 4:
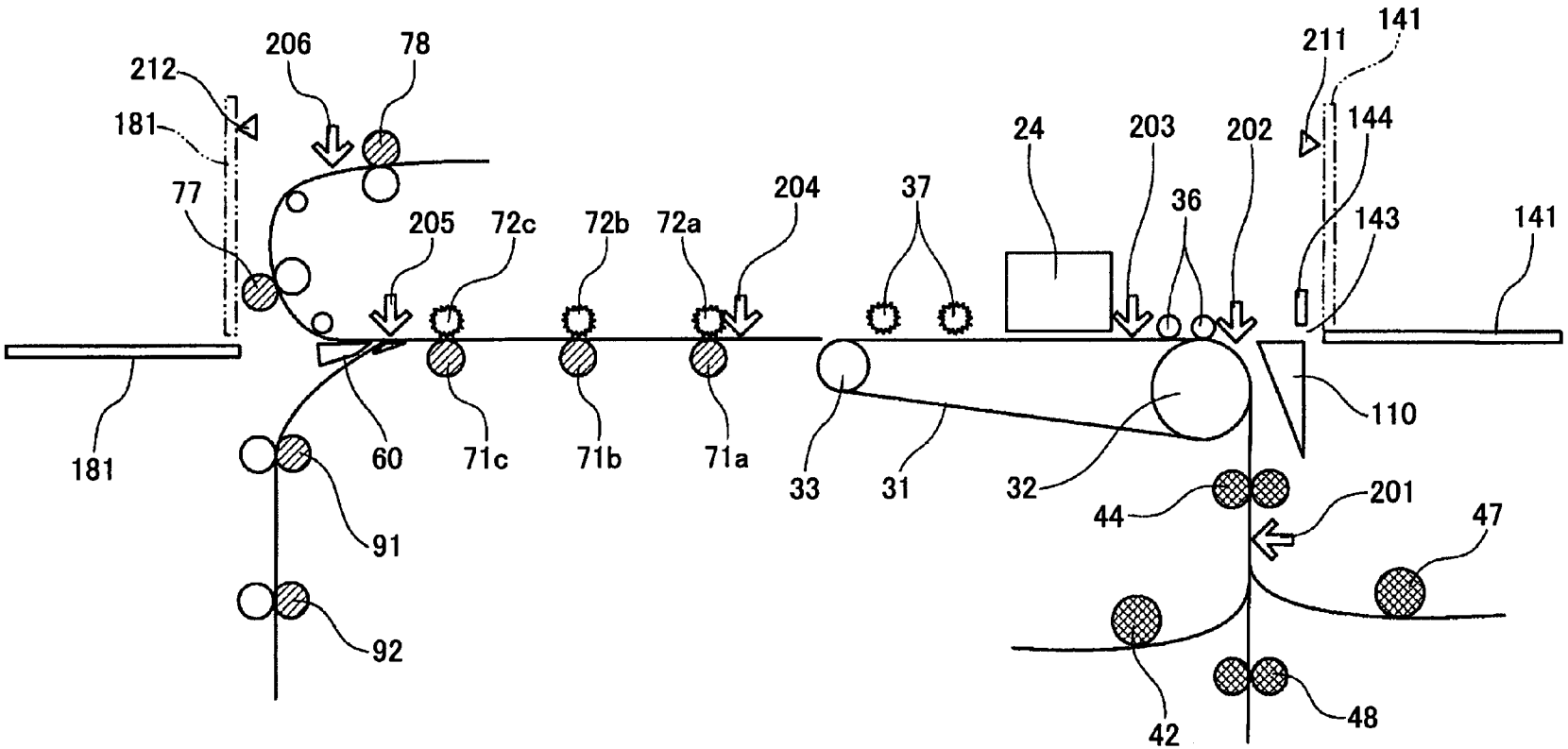
FIG. 4 is a diagram for illustrating paper conveyance paths relating to manual paper feeding of the image forming apparatus according to the first embodiment of the present invention.

First, an overview is given of an image forming apparatus according to a first embodiment of the present invention. FIG. 1 is a schematic diagram showing a configuration of the image forming apparatus. FIGS. 2 and 3 are a plan view and a side view, respectively, of an image forming part 2 and a sub scanning conveyance part 3 of the image forming apparatus. FIG. 4 is a diagram for illustrating paper conveyance paths relating to manual paper feeding of the image forming apparatus.

Inside (in the housing of) an apparatus main body 1, this image forming apparatus includes the image forming part 2 for forming an image on paper while conveying the paper and the sub scanning conveyance part 3 for conveying the paper. Sheets of paper 5 are fed one by one from a paper feed part (feed part) 4 provided at the bottom of the apparatus main body 1. The paper feed part 4 includes a paper feed cassette. While the sub scanning conveyance part 3 conveys each sheet of paper 5 at a position opposite the image forming part 2, the image forming part 2 forms (records) a required image on the sheet of paper 5 by ejecting liquid droplets thereonto. Thereafter, in the case of simplex (one-side) printing, the sheet of paper 5 is output through an output paper conveyance part 7 onto a paper output tray 8 formed on the upper surface of the apparatus main body 1. In the case of duplex (two-side) printing, the sheet of paper 5 is fed into a duplex unit 10 provided at the bottom of the apparatus main body 1 when the sheet of paper 5 is halfway through the output paper conveyance part 7. In the duplex unit 10, the sheet of paper 5 is conveyed in a switch-back manner, and is re-fed to the sub scanning conveyance part 3, where an image is also formed on the other side of the sheet of paper 5. Thereafter, the sheet of paper 5 is output onto the paper output tray 8.

Further, the image forming apparatus includes an image reading part (scanner part) 11 for reading images. The image reading part 11 is provided above the paper output tray 8 on the apparatus main body 1. The image reading part 11 serves as an input system for image data (printing data) formed in the image forming part 2. The image reading part 11 includes a scanning optical system 15 including an illumination light source 13 and a mirror 14, and a scanning optical system 18 including mirrors 16 and 17. The scanning optical systems 15 and 18 move so as to read the image of original material (for example, a document) placed on a contact glass 12. The scanned image of the original material is read as an image signal in an image reading device 20 disposed behind a lens 19. The read image signal is digitized and subjected to image processing, so that the image-processed printing data can be printed.

Further, this image forming apparatus can receive host-side printing data including image data through a cable or network from information processing apparatuses such as external personal computers, image reading apparatuses such as image scanners, and image capturing apparatuses such as digital cameras, and process and print the received printing data. This serves as another input system for image data (printing data) formed in the image forming part 2.

Referring to FIG. 2, in the image forming part 2 of the image forming apparatus, a guide rod 21 and a guide stay (not graphically illustrated) support a carriage 23 so that the carriage 23 is movable in the main scanning directions (carriage scanning directions). The carriage 23 is moved to scan in the main scanning directions by a main scanning motor 27 through a timing belt 29 engaged with and provided between a driving pulley 28A and a driven pulley 28B.

Recording heads 24 formed of multiple liquid droplet ejection heads ejecting liquid droplets of corresponding colors are mounted on the carriage 23. While the carriage 23 is being moved in the main scanning directions and the sheet of paper 5 is being fed in the paper conveyance direction (sub scanning direction) by the sub scanning conveyance part 3, liquid droplets are ejected from the recording heads 24, thereby performing image formation. Instead of such a shuttle-type head, a line-type head may also be used.

The recording heads 24 include five liquid droplet ejection heads: two liquid droplet ejection heads 24*k*1 and 24*k*2 each ejecting black (Bk) ink, and liquid droplet ejection heads 24*c*, 24*m*, and 24*y* ejecting cyan (C) ink, magenta (M) ink, and yellow (Y) ink, respectively. Hereinafter, the liquid droplet ejection heads 24*k*1, 24*k*2, 24*c*, 24*m*, and 24*y* may be referred to as "recording heads 24" when no distinction is made between colors. The liquid droplet ejection heads 24*k*1, 24*k*2, 24*c*, 24*m*, and 24*y* are supplied with corresponding color inks from corresponding sub tanks 25 mounted in the carriage 23.

On the other hand, as shown in FIG. 1, ink cartridges 26, which are recording liquid cartridges containing Bk ink, C ink, M ink, and Y ink, respectively, may be detachably attached to a cartridge attachment part from the front side of the apparatus main body 1, and the color inks are supplied from the respective ink cartridges 26 to the corresponding color sub tanks 25. The Bk ink is supplied from the corresponding single ink cartridge 26 to the corresponding two sub tanks 25.

Each recording head 24 may be of a piezoelectric type, a thermal type, an electrostatic type, etc. A piezoelectric recording head deforms a diaphragm forming a wall face of an ink channel (pressure generation chamber) using a piezoelectric element as a pressure generation part (actuator part) applying pressure to ink in the ink channel, thereby changing the inner volume of the ink channel to eject ink droplets. A thermal recording head ejects ink droplets with pressure due to generation of air bubbles caused by heating ink in an ink channel using a heat element. An electrostatic recording head has an electrode and a diaphragm forming a wall face of an ink channel disposed opposite each other, and causes the diaphragm to deform by an electrostatic force generated between the diaphragm and the electrode, thereby changing the inner volume of the ink channel to eject ink droplets.

Referring to FIG. 2, a maintenance and restoration device 121 for maintaining and restoring the nozzle condition of the recording heads 24 is disposed in the non-printing area on one side in the scanning directions of the carriage 23. The maintenance and restoration device 121 includes five moisture retention caps 122*k*1, 122*k*2, 122*c*, 122*m*, and 122*y* for capping the nozzle surfaces of the liquid droplet ejection heads 24*k*1, 24*k*2, 24*c*, 24*m*, and 24*y*, respectively (hereinafter, also referred to as "moisture retention caps 122" when no distinction is made between colors); a cap for suction 123, a wiper blade 124 for wiping the nozzle surfaces of the recording heads 24, and a blank ejection (flushing) reception member 125 for blank ejection, or ejection of liquid droplets that do not contribute to recording (image formation).

Referring further to FIG. 2, a blank ejection reception member 126 for blank ejection, or ejection of liquid droplets that do not contribute to recording (image formation), from the five recording heads 24 is provided on a non-printing area on the other side in the scanning directions of the carriage 23. Five openings 127*k*1, 127*k*2, 127*c*, 127*m*, and 127*y* corresponding to the liquid droplet ejection heads 24*k*1, 24*k*2, 24*c*, 24*m*, and 24*y*, respectively (hereinafter, also referred to as "openings 127" when no distinction is made between colors), are formed in the blank ejection reception member 126.

As shown also in FIG. 3, the sub scanning conveyance part 3 includes an endless conveyor belt 31, a charging roller 34, a guide member 35, two press rollers (pressure rollers) 36, two spur rollers 37, and a separation claw 38. The endless conveyor belt 31 is engaged with and provided between a conveyance roller 32, which is a driving roller, and a driven roller 33, which is a tension roller. The endless conveyor belt 31 conveys the sheet of paper 5 so that the sheet of paper 5 opposes the image forming part 2, changing the direction of conveyance of the sheet of paper 5 fed from below by substantially 90°. The charging roller 34 is a charging part to which an alternating high voltage is applied from a high voltage source in order to charge the surface of the conveyor belt 31. The guide member 35 guides the conveyor belt 31 in an area opposite the image forming part 2. The press rollers 36 press the sheet of paper 5 against the conveyor belt 31 in a position opposite the conveyance roller 32. The spur rollers 37 press the upper side of the sheet of paper 5 on which side an image is formed by the image forming part 2. The separation claw 38 separates the sheet of paper 5 on which an image is formed from the conveyor belt 31.

The conveyor belt 31 of the sub scanning conveyance part 3 is configured to rotate in the paper conveyance direction (sub scanning direction) of FIG. 2 as a result of the conveyance roller 32 being rotated by a sub scanning motor 131 through a timing belt 132 and a timing roller 133. The conveyor belt 31 may have a two-layer structure of a top (outer) layer and a bottom (inner) layer. The top layer serves as a paper adhesion surface to which the sheet of paper 5 adheres. The top layer is formed of a pure resin material, for instance, a pure ETFE (Ethylene Tetra Fluoro Ethylene) material, with no resistance control. The bottom layer is formed of the same material as the top layer, to which resistance control with carbon is provided. The bottom layer may also be referred to as a medium resistance layer or a ground layer. Alternatively, the conveyor belt 31 may also have a single-layer structure or a structure of three or more layers.

A cleaning part 135 for removing paper powder adhering to the surface of the conveyor belt 31 and a discharging brush 136 for removing an electric charge on the surface of the conveyor belt 31 are provided between the driven roller 33 and the charging roller 34. In this embodiment, Mylar is used as the cleaning part 135.

Figure 13:
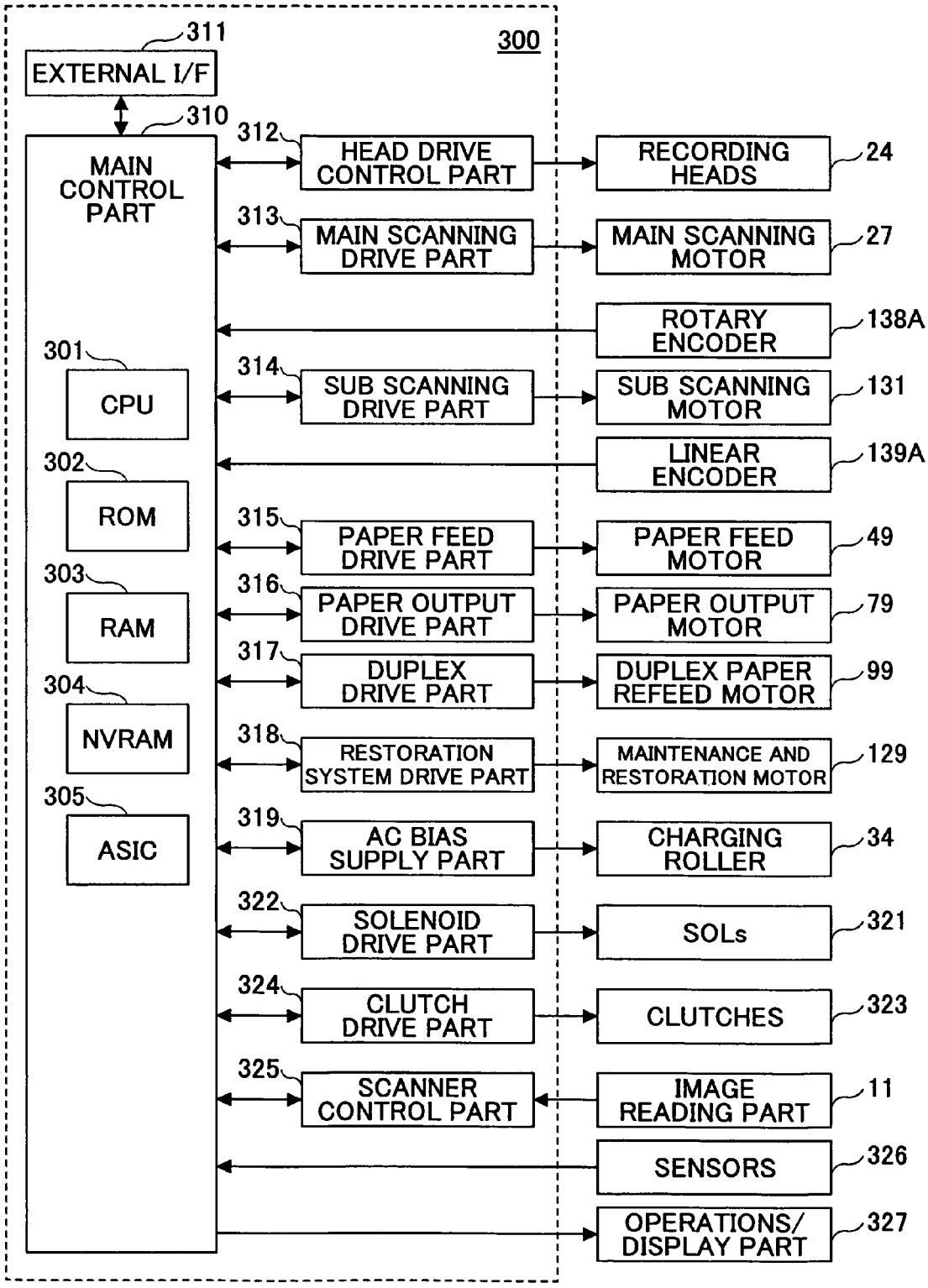
FIG. 13 is a block diagram showing a control part of the image forming apparatus according to the first embodiment of the present invention.

Further, a high-resolution code wheel 137 is attached to a shaft 32*a* of the conveyance roller 32. A transmission photosensor 138 detecting slits (not graphically illustrated) formed in the code wheel 137 is provided. The code wheel 137 and the photosensor 138 form a rotary encoder 138A (FIG. 13).

A linear scale (not graphically illustrated) is formed on the bottom-side (interior) surface (surface in contact with the exterior surface of the conveyance roller 32) of the conveyor belt 31. A reflection photosensor 139 for reading the linear scale is provided. The linear scale and the photosensor 139 form a linear encoder 139A (FIG. 13). The linear scale may be formed by vapor-depositing aluminum on the bottom-side surface of the conveyor belt 31, and thereafter, removing part of the aluminum with laser light so that the aluminum is formed into stripes. The linear scale is provided in a part where its reading by the reflection photosensor 139 is not hindered by the guide member 35. Further, a joint sensor 140 for detecting the joint of the linear scale provided on the rear-side (interior) surface of the conveyor belt 31 is provided adjacent to the sensor 139.

The paper feed part 4 can be inserted into and extracted from the apparatus main body 1 through its front side. The paper feed part 4 includes a paper feed cassette 41 containing the sheets of paper 5 in a stacked manner; a paper feed roller 42 and a friction pad 43 for separating and feeding the sheets of paper 5 in the paper feed cassette 41 one by one; and registration rollers 44 for performing registration of the fed sheets of paper 5. The paper feed part 4 further includes a manual feed tray 46 for containing multiple sheets of paper, which are also referred to by the same reference numeral 5 for convenience of description; a manual feed roller 47 for feeding the sheets of paper 5 one by one from the manual feed tray 46; and conveyance rollers 48 for conveying the sheets of paper 5 fed from a paper feed cassette optionally attached to the lower side of the apparatus main body 1 and from the duplex unit 10 to be described below. Members for feeding the sheets of paper 5 to the sub scanning conveyance part 3, such as the paper feed roller 42, the registration rollers 44, the manual feed roller 47, and the conveyance rollers 48, are rotated by a paper feed motor (drive part) 49 formed of an HB stepper motor through an electromagnetic clutch (not graphically illustrated).

The output paper conveyance part 7 includes three conveyance rollers 71*a*, 71*b*, and 71*c* for conveying each sheet of paper 5 separated by the separation claw 38. The conveyance rollers 71*a*, 71*b*, and 71*c* may be referred to as "conveyance rollers 71" when no distinction is made therebetween. The output paper conveyance part 7 also includes spurs 72*a*, 72*b*, and 72*c* opposing the conveyance rollers 71*a*, 71*b*, and 71*c*, respectively. The spurs 72*a*, 72*b*, and 72*c* may be referred to as "spurs 72" when no distinction is made therebetween. The output paper conveyance part 7 further includes a lower guide part 73 and an upper guide part 74 guiding the sheet of paper 5 conveyed between the paper conveyance rollers 71 and the spurs 72; and a pair of reversing rollers 77 and a pair of reverse paper output rollers 78 for reversing the sheet of paper 5 fed from between the lower guide part 73 and the upper guide part 74 through a reverse paper output path 81 serving a first conveyance path and outputting the sheet of paper 5 onto the paper output tray 8 in a face-down manner. The conveyance path through which the sheet of paper 5 is conveyed between the lower guide part 73 and the upper guide part 74 is referred to as a conveyance path 70.

A branch (switch) mechanism 60 for switching to one of the reverse paper output path (first paper output path) 81 for reverse paper output onto the paper output tray 8, a straight paper output path (second paper output path) 82 for paper output onto a straight paper output tray 181 (to be described below), and the duplex unit 10 is provided on the exit side of the conveyance path 70.

The duplex unit 10 includes a vertical conveyance part 101*a* and a horizontal conveyance part 101*b* as a unit. The vertical conveyance part 101*a* includes a vertical duplex conveyance path 90*c* that receives the fed sheet of paper 5 from a side part of the apparatus main body 1 and conveys the sheet of paper 5 downward. The horizontal conveyance part 101*b* includes a horizontal take-in conveyance path 90*a* and a switch-back conveyance path 90*b*. The horizontal take-in conveyance path 90*a* is subsequent to the vertical duplex conveyance path 90*c* so as to horizontally convey the sheet of paper 5.

The vertical duplex conveyance path 90*c* has a pair of duplex entrance rollers 91 conveying the fed sheet of paper 5 downward and a pair of conveyance rollers 92 feeding out the sheet of paper 5 to the horizontal take-in conveyance path 90*a*. The horizontal take-in conveyance path 90*a* has five pairs of duplex conveyance rollers 93. The switch-back conveyance path 90*b* has a pair of duplex exit rollers 94 and three pairs of duplex conveyance rollers 95. The duplex exit rollers 94 are formed of reverse rollers for reversing and refeeding the sheet of paper 5 fed from the horizontal take-in conveyance path 90*a*.

A branch (switch) plate 96 for switching between the conveyance path of the sheet of paper 5 from the horizontal take-in conveyance path 90*a* to the switch-back conveyance path 90*b* and the conveyance path for refeeding the sheet of paper 5 from the switch-back conveyance path 90*b* to the conveyance rollers 48 is provided swingably. The branch plate 96 is swingable between a position on the switch-back side indicated by a solid outline in FIG. 1 and a position on the paper-refeeding side indicated by a broken outline in FIG. 1.

The sheet of paper 5 fed from the duplex unit 10 is fed into the above-described conveyance rollers 48 to be sent to the registration rollers 44.

Further, as shown in FIG. 1, an opening and closing guide plate 110 is provided swingably in order to prevent back tension on the sheet of paper 5 by forming a loop (curve or slackness) therein the sheet of paper 5 between the conveyance roller 32 and the press rollers 36 of the sub scanning conveyance part 3 and the registration rollers 44 when the sheet of paper 5, fed from any of the paper feed cassette 41 and the manual feed tray 46 of the paper feed part 4 and the duplex unit 10, is conveyed by the registration rollers 44.

When the sheet of paper 5 is fed from the registration rollers 44 to the sub scanning conveyance part 3, the opening and closing guide plate 110 swings in the direction indicated by the arrow from the state shown in FIG. 1, so as to guide the sheet of paper 5. When the sheet of paper 5 reaches the sub scanning conveyance part 3, the opening and closing guide plate 110 returns to the state shown in FIG. 1 so as to allow loop formation.

Further, as shown in FIG. 1, in this image forming apparatus, a single-sheet manual paper feed tray 141 is provided on a first side part of the apparatus main body 1 so as to be openable (able to be pulled down and open) and closable (retractable) with respect to the apparatus main body 1 in order to feed a single sheet of paper manually. In the case of performing single-sheet manual feeding (manually feeding one sheet of paper at a time), the single-sheet manual paper feed tray 141 is pulled down and open at a position indicated by an imaginary (two-dot chain) line in FIG. 1. The sheet of paper 5 fed manually from the single-sheet manual paper feed tray 141 is guided by an upper surface (horizontal guide surface) 110*b* (FIGS. 5 and 6) of the opening and closing guide plate 110, and can be directly inserted linearly between the conveyance roller 32 and the press rollers 36 of the sub scanning conveyance part 3.

On the other hand, the straight paper output tray 181 is provided on a second side part of the apparatus main body 1 so as to be openable (able to be pulled down and open) and closable (retractable) with respect to the apparatus main body 1 in order to output the sheet of paper 5 subjected to image formation straight in a face-up manner. The second side part is on the side opposite to the first side part of the apparatus main body 1. By opening (pulling down) the straight paper output tray 181, the straight paper output path 82, which is the second paper output path for outputting straight onto the straight paper output tray 181 the sheet of paper 5 fed from the lower guide part 73 and the upper guide part 74 to the output paper conveyance part 7, is formed.

As a result, in the case of using paper difficult to convey by curvilinear conveyance, such as an OHP sheet and thick paper, a single sheet of paper can be fed manually from the single-sheet manual paper feed tray 141 and conveyed linearly and horizontally to the straight paper output tray 181. It is also possible to feed common paper such as plain paper from the single-sheet manual paper feed tray 141 and output the paper linearly onto the straight paper output tray 181.

A description is given, with reference to FIG. 4, of disposition of sensors according to the first embodiment. A conveyance registration sensor 201 is disposed on the upstream side of the registration rollers 44 in order to detect the sheet of paper 5. A printing part entrance sensor 202 is disposed in front of the conveyance roller 32 and the upstream-side press roller 36. An image registration sensor 203 for registration of an image writing start position is disposed on the downstream side of the downstream-side press roller 36 (at the entrance of the image forming part 2). A printing part exit sensor 204 is disposed at the exit of the image forming part 2 (in front of the conveyance roller 71*a*). A branch sensor 205 is disposed at the part of the branch mechanism 60. A paper output sensor 206 is disposed in front of the paper output rollers 78.

Further, a manual feed tray opening detection sensor 211 for detecting the opening and closing of the single-sheet manual paper feed tray 141, and a paper output tray opening detection sensor 212 for detecting the opening and closing of the straight paper output tray 181 are provided. Although not graphically illustrated in FIG. 4, a duplex entrance sensor is disposed on the entrance side of the horizontal take-in conveyance part 90*a* of the duplex unit 10, and a reversal sensor is disposed between the exit of the horizontal take-in conveyance part 90*a* and the entrance of the switch-back conveyance path 90*b*.

Figure 5:
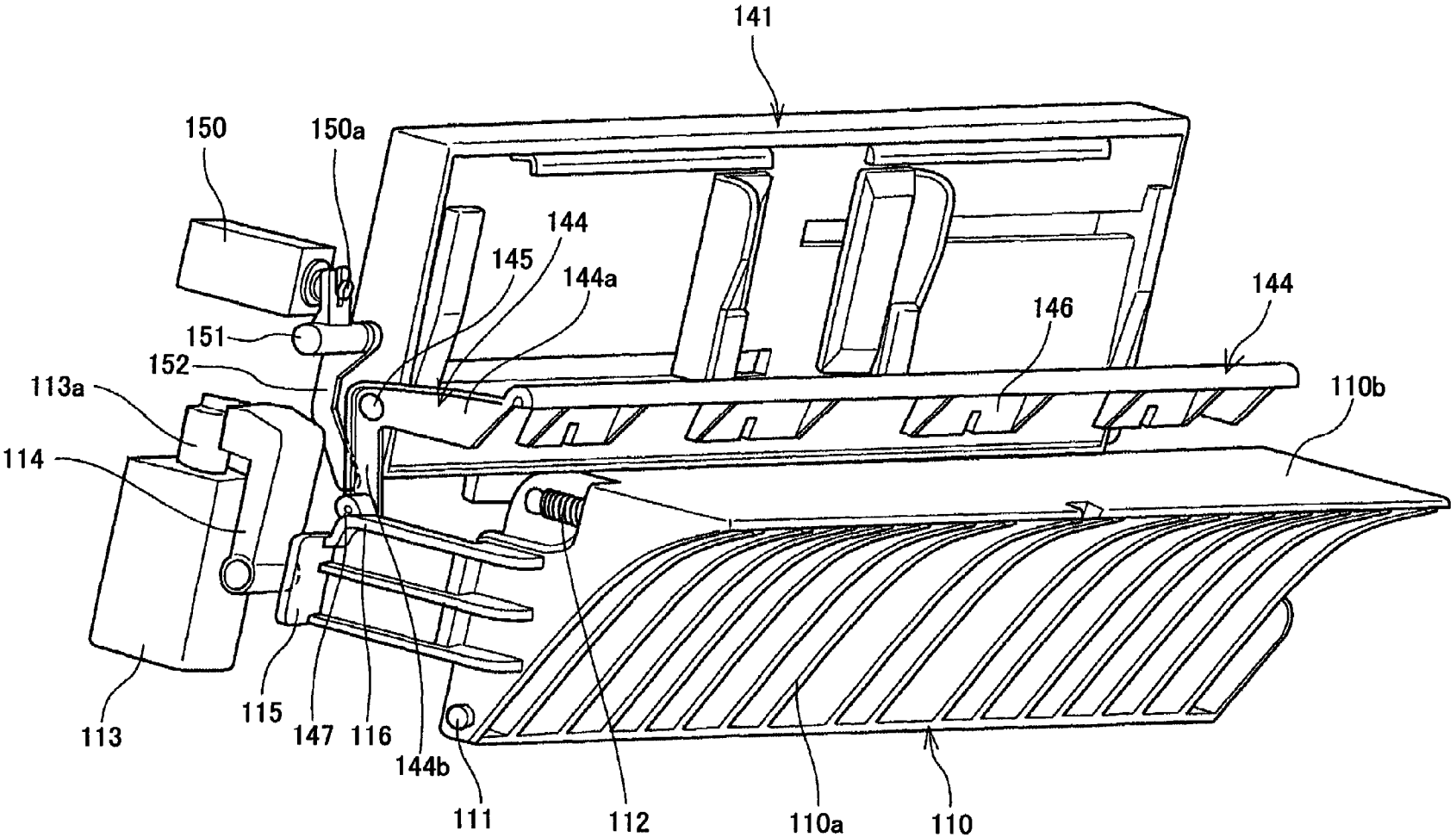
FIG. 5 is a perspective view of a single-sheet manual paper feed part of the image forming apparatus according to the first embodiment of the present invention.
Figure 6:
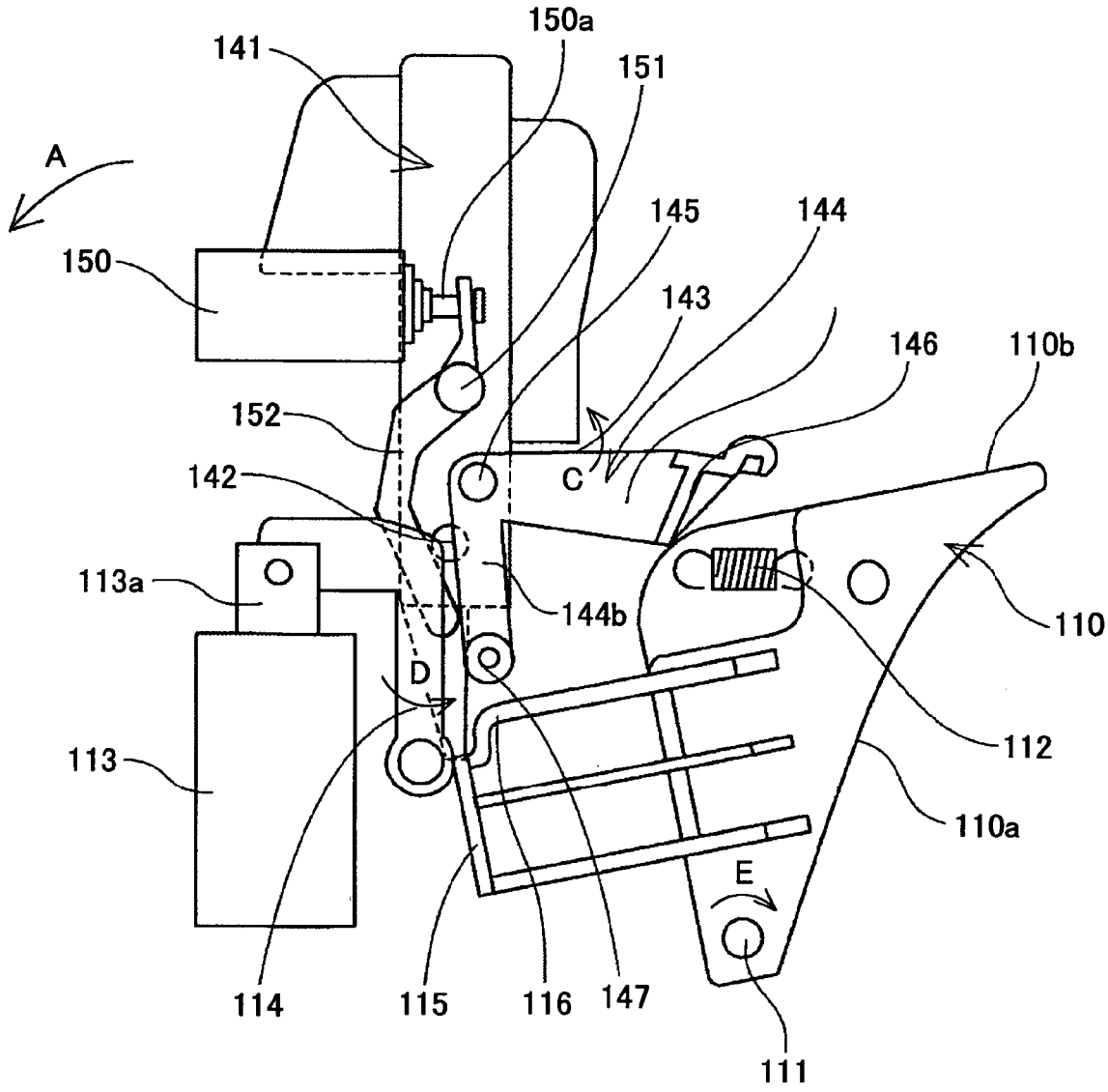
FIG. 6 is a side view of the single-sheet manual paper feed part according to the first embodiment of the present invention.

Next, a description is given, with reference to FIGS. 5 and 6, of the configuration of a single-sheet manual paper feed part (single-sheet manual feed part). FIG. 5 is a perspective view of the single-sheet manual paper feed part. FIG. 6 is a side view of the single-sheet manual paper feed part.

First, a description is given of the above-described opening and closing guide plate 110 and its swinging mechanism. The opening and closing guide plate 110, which is an opening and closing guide member, is disposed so as to be swingable through a support shaft 111. A tension spring 112 holds the opening and closing guide plate 110 in a loop formation position (position of FIG. 6) staying out of the conveyance path between the registration rollers 44 and the sub scanning conveyance part 3.

The opening and closing guide plate 110 has a guide surface 110*a* curved in a vertical direction. The guide surface 110*a* guides the sheet of paper 5 fed from the registration rollers 44. The horizontal guide surface 110*b* of the opening and closing guide plate 110 guides the sheet of paper 5 fed manually from the single-sheet manual paper feed tray 141. Using the upper surface of the opening and closing guide plate 110 also as a guide surface for single-sheet manual feeding results in a simple configuration.

On the other hand, in order to swing the opening and closing guide plate 110, the following configuration is provided. An opening and closing guide plate solenoid 113 serving as a drive part is provided, and a swing arm 114 is attached to a plunger 113*a* of the opening and closing guide plate solenoid 113. The end part of the swing arm 114 is in contact with a contact part 115 formed integrally with the opening and closing guide plate 110. When the opening and closing guide plate solenoid 113 is driven, the plunger 113*a* is pulled so that the swing arm 114 swings in the direction indicated by the arrow D in FIG. 6 so as to cause the opening and closing guide plate 110 to swing in the direction indicated by the arrow E in FIG. 6 against the biasing force of a tension spring 112.

In this case, at the time of guiding the sheet of paper 5 fed from the registration rollers 44 to the sub scanning conveyance part 3, the opening and closing guide plate solenoid 113 is driven so that the opening and closing guide plate 110 is ready to guide the fed sheet of paper 5, and driving of the opening and closing guide plate solenoid 113 is stopped at predetermined timing so as to bring back the opening and closing guide plate 110 to the initial position shown in FIG. 6 so that slackness (a curve) can be formed in the sheet of paper 5 between the registration rollers 44 and the sub scanning conveyance part 3.

As described above, the single-sheet manual paper feed tray 141 is attached to the apparatus main body through support shafts 142 so as to be openable and closable with respect to the apparatus main body 1. A shutter member 144 configured to open and close a manual paper feed opening 143 is provided on the interior side of the single-sheet manual paper feed tray 141 so as to be swingable through support shafts 145. A sidewall (not graphically illustrated) is provided on each side of the single-sheet manual paper feed tray 141 between the single-sheet manual paper feed tray 141 and the shutter member 144. The support shafts 142 are supported by the sidewalls so as to project inward therefrom, and the support shafts 145 are supported by the sidewalls so as to project outward therefrom.

The shutter member 144 includes an arm part 144*a* having a stopper part 146 formed at an end part thereof, and an arm part 144*b* for interlocking the shutter member 144 with the opening and closing guide plate 110. The stopper part 146 is capable of blocking the sheet of paper 5 fed manually from the single-sheet manual paper feed tray 141. The arm part 144*b* has an engagement roller 147 provided rotatably at an end part thereof. The engagement roller 147 engages an engagement part 116 formed integrally with the opening and closing guide plate 110. In a stationary state, the shutter member 144 is in the condition shown in FIG. 6 where the arm part 144*b* does not engage the opening and closing guide plate 110, that is, the arm part 144*b* is not interlocked with swinging of the opening and closing guide plate 110.

In order to engage the arm part 144*b* of the shutter member 144 with the opening and closing guide plate 110, thereby switching the position of the shutter member 144 to where the shutter member 144 is interlocked with swinging of the opening and closing guide plate 110, a shutter switching solenoid 150, which is an electric drive part, is provided as a switch part. One end of a swing arm 152 at which end a support shaft 151 is rotatably supported is joined to a plunger 150*a* of the shutter switching solenoid 150. The swing arm 152 is disposed so that the other end thereof can be in contact with the arm part 144*b* of the shutter member 144. When the shutter switching solenoid 150 is driven, the shutter member 144 swings in the direction indicated by the arrow C in FIG. 6, so that the arm part 144*b* engages the engagement part 116 of the opening and closing guide plate 110, thereby switching the position of the shutter member 144 to where the shutter member 144 is interlocked with swinging of the opening and closing guide plate 110.

Next, a description is given, with reference to FIGS. 6 through 10, of an operation of the single-sheet manual paper feed part. FIGS. 7 through 10 are side views of the single-sheet manual paper feed part as FIG. 6.

Figure 7:
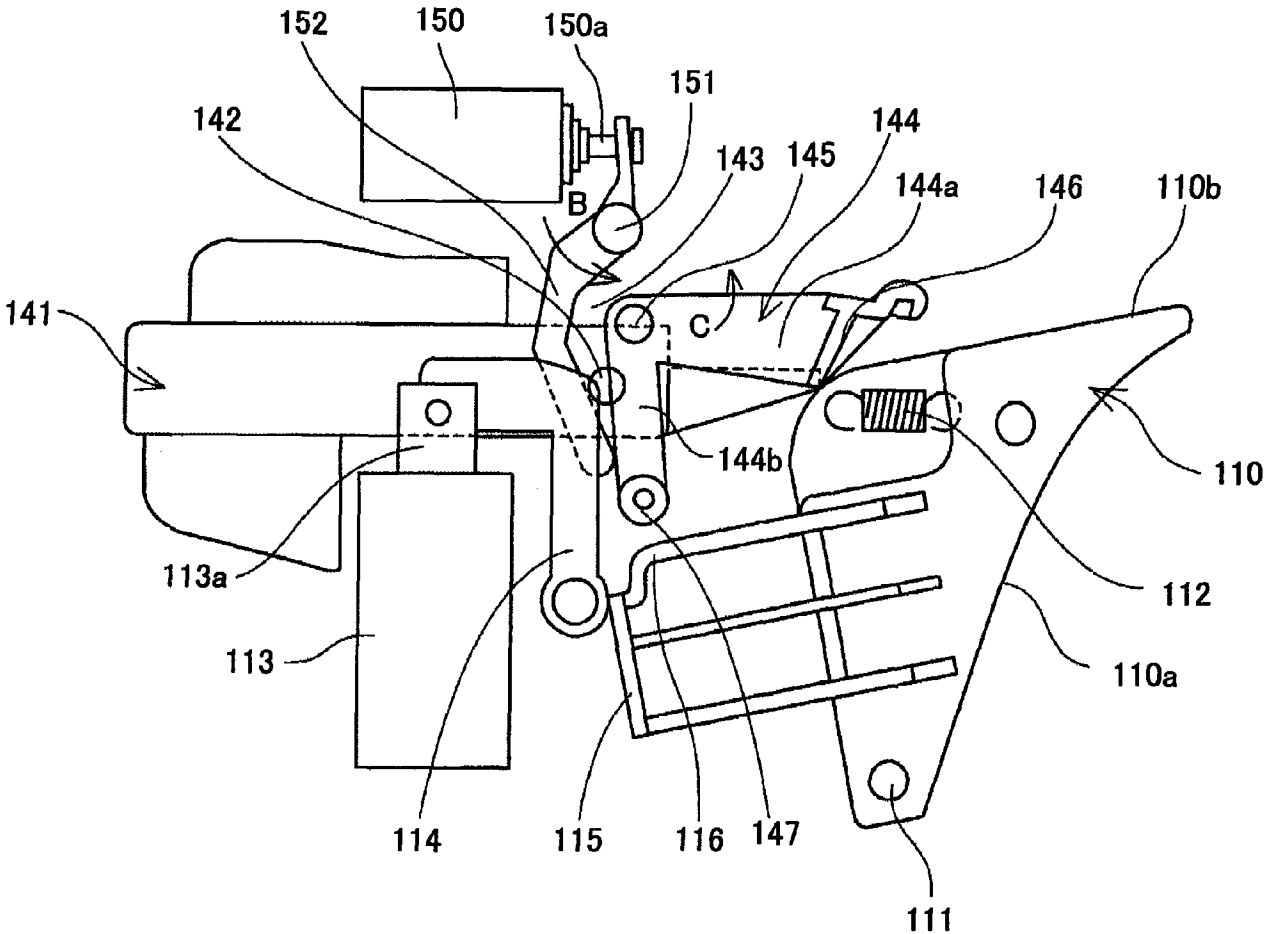
FIG. 7 is a side view of the single-sheet manual paper feed part where a single-sheet manual paper feed tray is open according to the first embodiment of the present invention.
Figure 8:
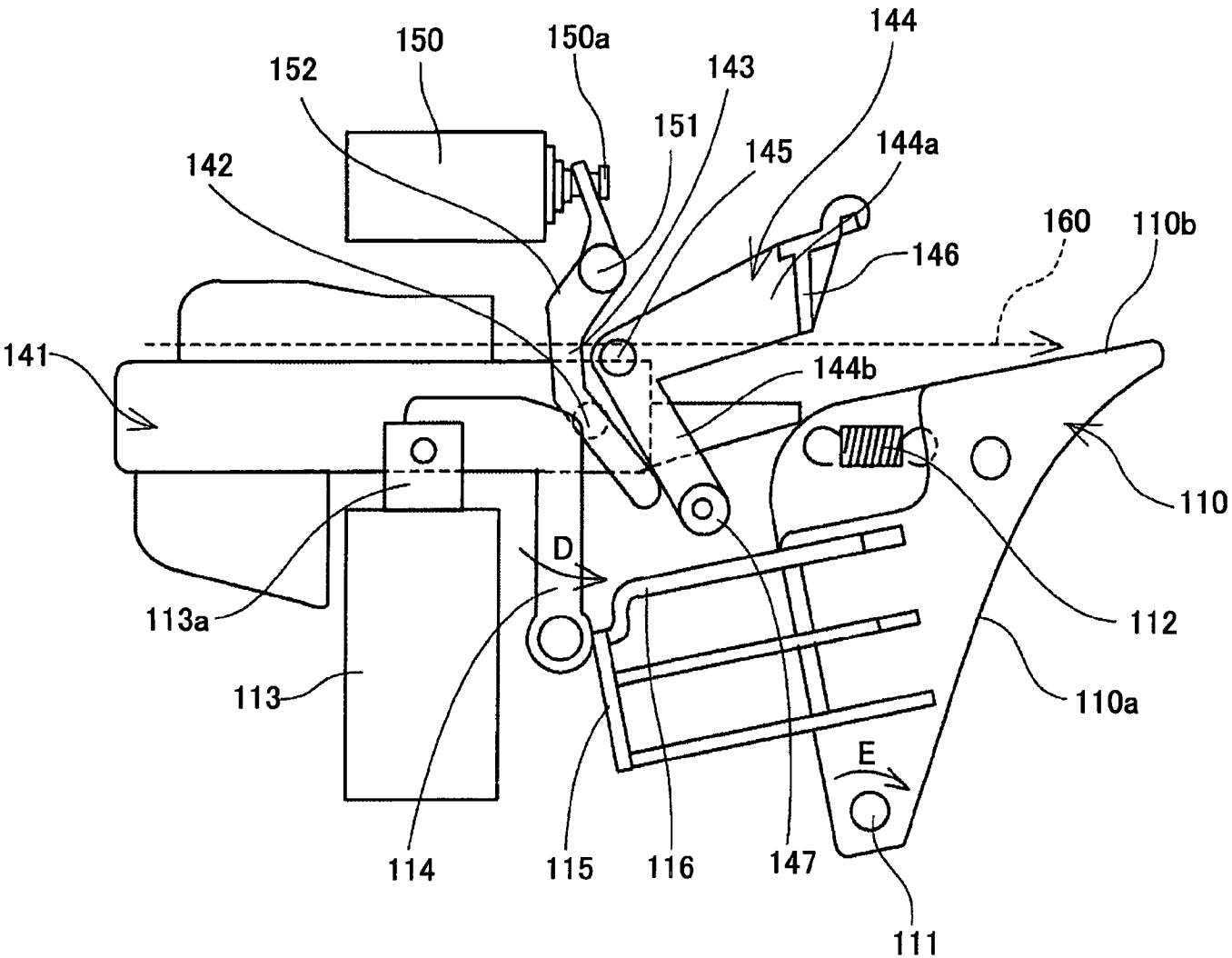
FIG. 8 is a side view of the single-sheet manual paper feed part where a shutter switching solenoid is ON according to the first embodiment of the present invention.

First, the single-sheet manual paper feed tray 141 is opened in the direction indicated by the arrow A in the state shown in FIG. 6, so that the single-sheet manual paper feed tray 141 is usable as shown in FIG. 7. Thereafter, at timing as required, the shutter switching solenoid 150 is driven (turned ON). As a result, the swing arm 152 swings in the direction indicated by the arrow B in FIG. 7 so as to cause the shutter member 144 to swing in the direction indicated by the arrow C in FIG. 7. In consequence, as shown in FIG. 8, the stopper part 146 of the shutter member 144 swings up to a position to open a single-sheet manual paper feed path 160. In this state, the arm part 144*b* of the shutter member 144 is caused to be engageable with the engagement part 116 of the opening and closing guide plate 110. That is, the shutter member 144 is positioned so as to be interlocked with the opening and closing guide plate 110.

Before this state, the stopper part 146 of the shutter member 144 is positioned in the single-sheet manual paper feed path 160 so as to close the manual paper feed opening 143. Therefore, even if an attempt is made to manually feed the sheet of paper 5 from the single-sheet manual paper feed tray 141, the stopper part 146 prevents the sheet of paper 5 from being fed.

Figure 9:
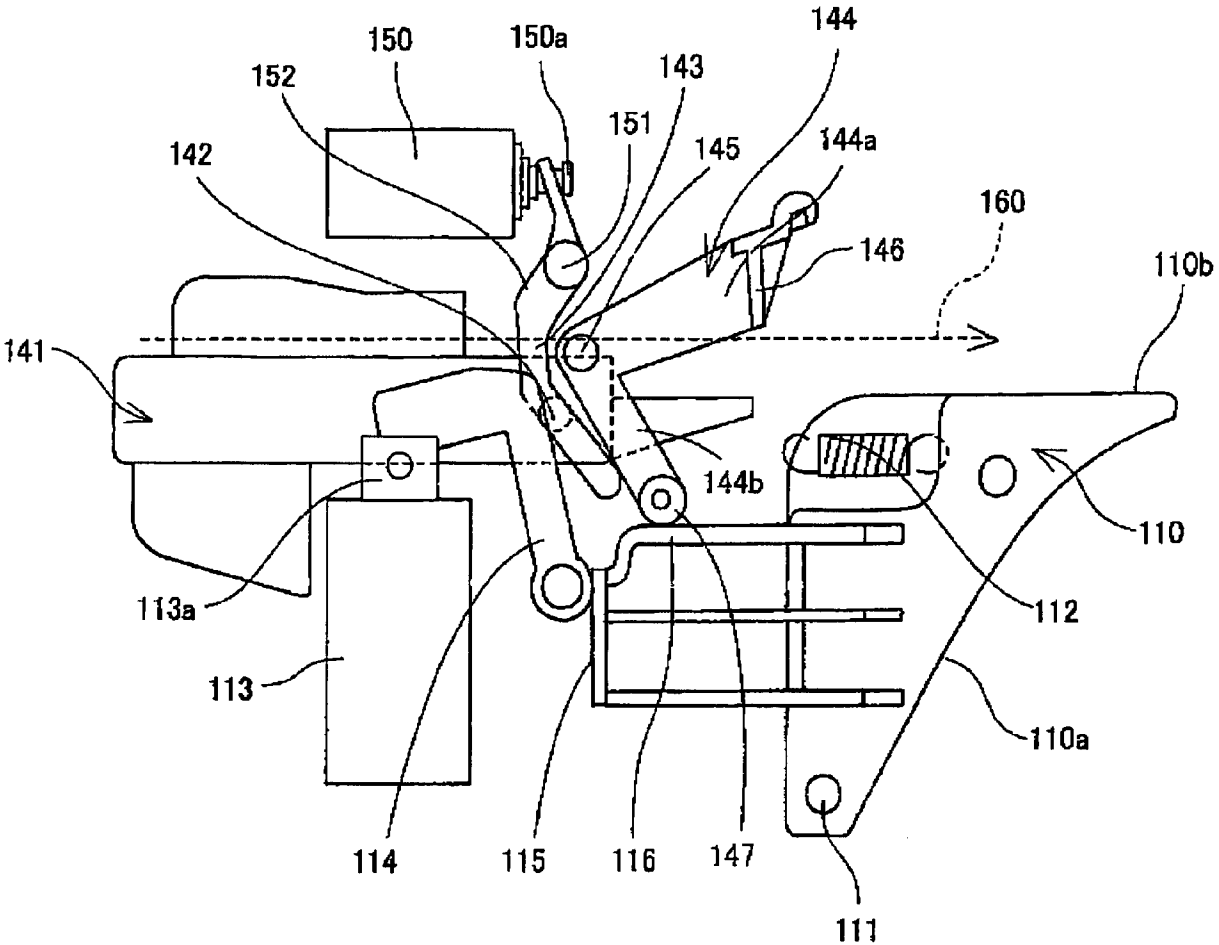
FIG. 9 is a side view of the single-sheet manual paper feed part where an opening and closing guide plate solenoid is driven according to the first embodiment of the present invention.

Referring to FIG. 8, then, the opening and closing guide plate solenoid 113 is driven so as to cause the swing arm 114 to swing in the direction indicated by the arrow D, thereby causing the opening and closing guide plate 110 to swing in the direction indicated by the arrow E. As a result, as shown in FIG. 9, the engagement part 116 of the opening and closing guide plate 110 engages the engagement roller 147 of the arm part 144*b* of the shutter member 144. Therefore, the shutter member 144 and the opening and closing guide plate 110 can be interlocked with each other, and the upper surface 110*b* of the opening and closing guide plate 110 can guide manually fed paper.

As a result, the manual paper feed opening 143 is opened and the single-sheet manual paper feed path 160 is opened, so that the sheet of paper 5 can be manually fed to the sub scanning conveyance part 3 using the single-sheet manual paper feed tray 141.

Figure 10:
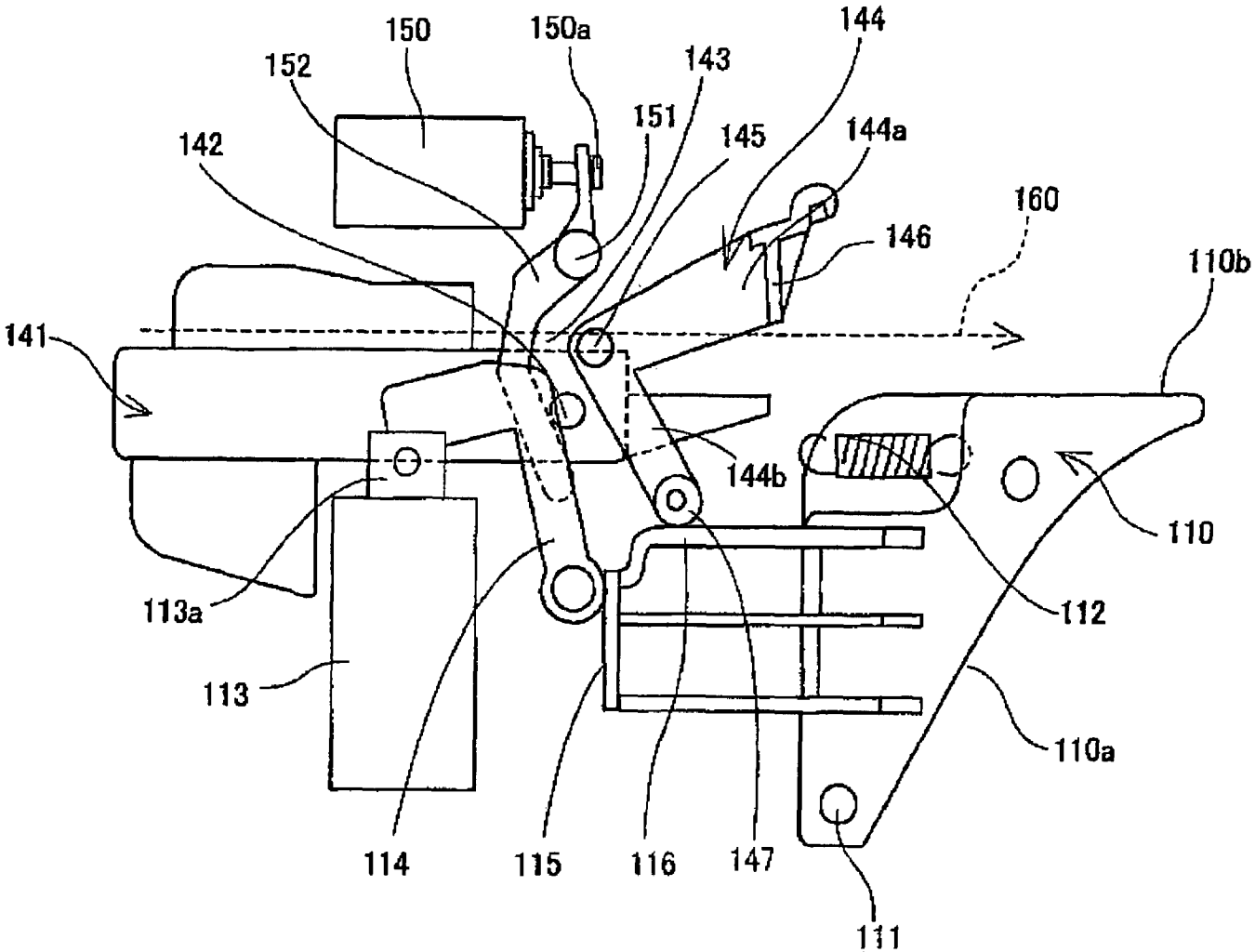
FIG. 10 is a side view of the single-sheet manual paper feed part where the shutter switching solenoid is OFF according to the first embodiment of the present invention.

After engaging the opening and closing guide plate 110, the arm part 144*b* of the shutter member 144 is interlocked with the opening and closing guide plate 110. Accordingly, bringing back the swing arm 152 to its initial position by the shutter switching solenoid 150 does not affect the opening of the shutter member 144 (FIG. 10).

That is, although the shutter member 144 itself swings to the OPEN position with the shutter switching solenoid 150 being ON, the attracted state of the plunger 150*a* (state where the shutter member 144 is open) cannot be maintained for a long period of time since the solenoid 150 used is small in size. Therefore, after the shutter member 144 swings up to the OPEN position shown in FIG. 9, the shutter member 144 is interlocked with the opening and closing guide plate 110 so that the solenoid 113 maintains the open state of the shutter member 144, while the shutter switching solenoid 150 is turned OFF as shown in FIG. 10.

Thus, a shutter member configured to open and close a manual paper feed opening from a single-sheet manual paper feed tray may be provided swingably. As a result, even when the single-sheet manual paper feed tray is made ready for manual paper feeding, or put in use, while paper is remaining inside the apparatus, it is possible to have a manual paper feed opening (a conveyance path for manual paper feeding) closed, and accordingly, to prevent occurrence of a jam due to manual paper feeding. In particular, even in the case where it is possible to perform single-sheet manual paper feeding without using registration rollers and a paper feed roller as in this embodiment, it is possible to ensure that manual paper feeding is blocked while paper is remaining inside the apparatus.

In this case, a swingable opening and closing guide member for providing slackness in paper in the paper conveyance path from a paper feed part to an image forming part may be provided. Further, the manual paper feed opening of the single-sheet manual paper feed tray may be disposed on the downstream side of the opening and closing guide member in the paper conveyance direction from the paper feed part to the image forming part so that swinging of the opening and closing guide member is interlocked with opening and closing of the shutter member. As a result, even in the case of using an electric drive part (such as a solenoid as described above) in order to open and close the shutter member, it is only necessary to cause the shutter member to swing up to a condition where the shutter member engages the opening and closing guide member (a position where the shutter member is interlocked with the opening and closing guide member). Accordingly, it is possible to employ a drive part small in size and capacity, so that it is possible to reduce cost.

Further, the shutter member may be thus provided so as to be switchable between a position where the shutter member is not interlocked with the opening and closing guide member and a position where the shutter member is interlocked with the opening and closing guide member. As a result, even when the opening and closing guide member is caused to swing at the time of paper feeding from a regular paper feed part, the shutter member is prevented from swinging, so that it is possible to eliminate noise and unnecessary movement of the shutter member.

Figure 11:
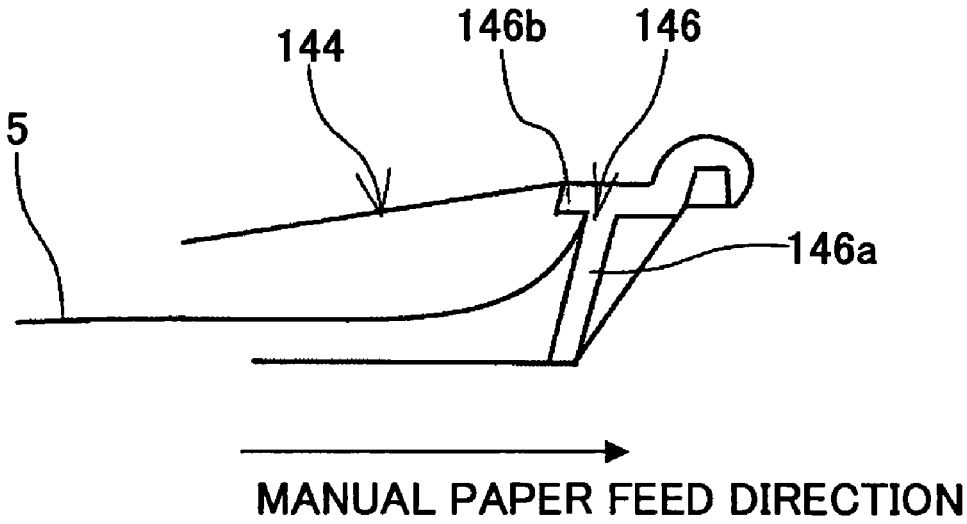
FIG. 11 is a diagram for illustrating a stopper part of a shutter member according to the first embodiment of the present invention.

Next, a description is given, with reference to FIG. 11, of the shape and the action of the stopper part 146 of the shutter member 144.

The stopper part 146 of the shutter member 144 has a control part (inclination part) 146*a* extending upward at an angle to the manual paper feed direction, and an upper control part 146*b* extending in the direction opposite to the manual paper feed direction from the upper end of the control part 146*a*. This configuration makes it possible to ensure that the sheet of paper 5 is guided obliquely upward by the control part 146*a* to be stopped by the upper control part 146*b* even if the sheet of paper 5 is manually fed while the shutter member 144 is closed.

Figure 12:
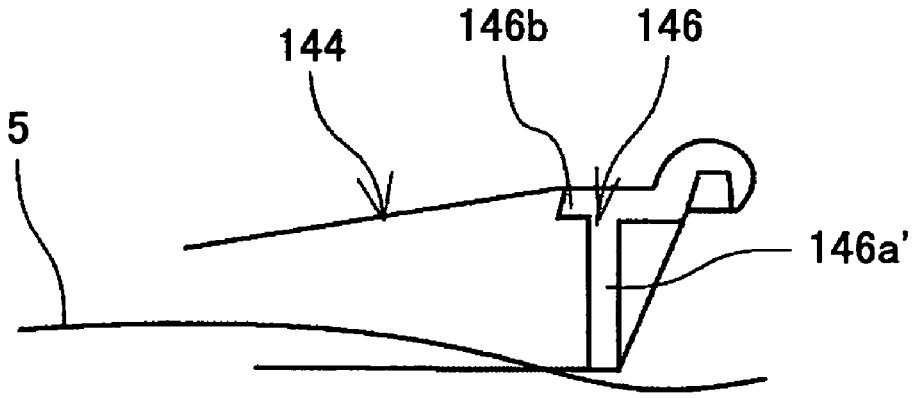
FIG. 12 is a diagram for illustrating a comparative example of the stopper part of the shutter member according to the first embodiment of the present invention.

On the other hand, for example, if the stopper part 146 of the shutter member 144 has a control part 146*a*' perpendicular to the manual paper feed direction as shown in FIG. 12, the manually fed sheet of paper 5 may slip through under the lower end of the control part 146*a*' so as to be fed further. Accordingly, it is desirable that the stopper part 146 be shaped to have the control part 146*a* as shown in FIG. 11.

Next, an overview is given, with reference to FIG. 13, of a control part 300 of the image forming apparatus according to this embodiment. FIG. 13 is a block diagram showing a configuration of the control part 300.

The control part 300 includes a main control part 310 controlling the entire apparatus. The main control part 310 includes a CPU 301, a ROM 302, a RAM 303, a nonvolatile memory (NVRAM) 304, and an application specific integrated circuit (ASIC) 305. The ROM 302 stores programs executed by the CPU 301, and other fixed data. The RAM 303 temporarily stores data such as image data. The NVRAM 304 retains data while the apparatus is turned off. The ASIC 305 processes various signals with respect to image data, performs image processing including rearrangement, and processes input and output signals for controlling the entire apparatus.

The control part 300 further includes an external interface (I/F) 311, a head drive control part 312, a main scanning drive part (motor driver) 313, a sub scanning drive part 314, a paper feed drive part 315, a paper output drive part 316, a duplex drive part 317, a restoration system drive part 318, and an AC bias supply part 319. The external I/F 311 intervenes between a host and the main control part 310 in order to transmit and receive data and signals. The head drive control part 312 includes a head driver for controlling driving of the recording heads 24. The main scanning drive part 313 drives the main scanning motor 27 causing the carriage 23 to move and scan. The sub scanning drive part 314 drives the sub scanning motor 131 based on the detection results of the rotary encoder 138A and the linear encoder 139A. The paper feed drive part 315 drives the paper feed motor 49. The paper output drive part 316 drives a paper output motor 79 driving the rollers of the output paper conveyance part 7. The duplex drive part 317 drives a duplex paper refeed motor 99 driving the rollers of the duplex unit 10. The restoration system drive part 318 drives a maintenance and restoration motor 129 driving the maintenance and restoration device 121. The AC bias supply part 319 supplies an AC bias to the charging roller 34.

The control part 300 also includes a solenoid drive part (driver) 322, a clutch drive part 324, and a scanner control part 325. The solenoid drive part 322 drives various solenoids (SOLs) including the shutter switching solenoid 150. The clutch drive part 324 drives paper-feed-related electromagnetic clutches 323. The scanner control part 325 controls the image reading part 11.

Further, various detection signals from sensors 326 are input to the main control part 310. The sensors 326 include the sensors 201 through 206 for paper detection, the manual feed tray opening detection sensor 211 for detecting the opening and closing of the single-sheet manual paper feed tray 141, and the paper output tray opening detection sensor 212 for detecting the opening and closing of the straight paper output tray 181. The main control part 310 receives a necessary key input from an operations and display part 327 provided on the apparatus main body 1, and outputs information to be displayed thereto. The operations and display part 327 includes a numeric keypad, various keys such as a start key, and various indicators.

A brief description is given of control of an image forming operation by the control part 300. An alternating high voltage of a rectangular wave with positive and negative polarities is applied from the AC bias supply part 319 to the charging roller 34. Since the charging roller 34 is in contact with the insulating layer (top layer) of the conveyor belt 31, positive and negative electric charges are applied alternately like belts (stripes) to the top layer of the conveyor belt 31 in the conveyance direction of the conveyor belt 31. As a result, the surface of the conveyor belt 31 is charged with a predetermined charge width, so that a non-uniform electric field is generated thereon.

When the sheet of paper 5 from the paper feed part 4, the manual feed tray 46, the duplex unit 10, or the single-sheet manual paper feed tray 141 is fed onto the conveyor belt 31 between the conveyance roller 32 and the press rollers 36, where a non-uniform electric field is generated because of formation of positive and negative charges, the sheet of paper polarizes instantaneously after the orientation of the electric field, and is attracted and attached to the conveyor belt 31 by an electrostatic adhesive force so as to be conveyed with the movement of the conveyor belt 31.

While the sheet of paper 5 is being conveyed intermittently by the conveyor belt 31, the recording heads 24 eject liquid droplets of recording liquid onto the sheet of paper 5 in accordance with printing data, thereby forming (printing) an image thereon. The leading edge of the sheet of paper 5 on which the image is formed is separated from the conveyor belt 31 by the separation claw 38. Thereafter, appropriately, the output paper conveyance part 7 outputs the sheet of paper 5 onto the paper output tray 8 or the straight paper output tray 181, or feeds the sheet of paper 5 into the duplex unit 10 and outputs the sheet of paper 5 after an image is formed on the other side thereof.

Figure 14:
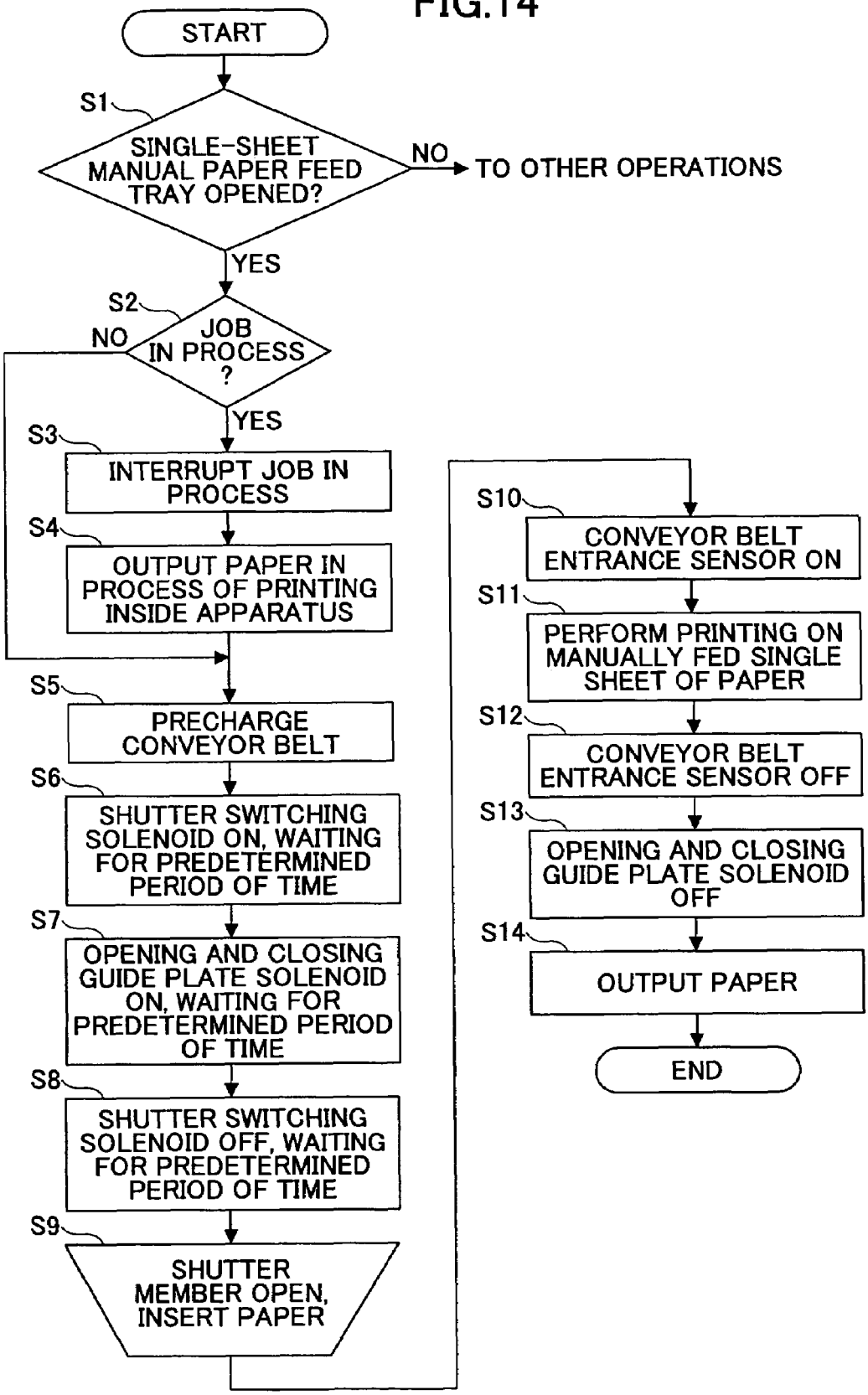
FIG. 14 is a flowchart showing an operation of the control part at the time of single-sheet manual paper feeding according to the first embodiment of the present invention.

Next, a description is given, with reference to FIG. 14, of the operation of image formation by single-sheet manual paper feeding using the single-sheet manual paper feed tray 141.

First, in step S1, it is determined whether the single-sheet manual paper feed tray 141 is opened. If the single-sheet manual paper feed tray 141 is opened (YES in step S1), in step S2, it is determined whether there is a job in process (JOB). If there is a job in process (YES in step S2), it means that there is paper remaining inside the apparatus. Accordingly, in step S3, the job in process is interrupted, and in step S4, an operation is performed to output the paper on which printing is being performed inside the apparatus. At this point, as shown in FIG. 7, the manual paper feed opening 143 is closed by the shutter member 144. Accordingly, no sheet of paper can be fed manually.

After the paper of the job in process has been output in step S4, or if there is no job in process (NO in step S2), in step S5, the conveyor belt 31 is precharged. Thereafter, in step S6, the shutter switching solenoid 150 is driven (turned ON) into the state shown in FIG. 8, and waiting continues for a predetermined period of time, for example, 500 msec. Thereafter, in step S7, the opening and closing guide plate solenoid 113 is driven (turned ON) so that the shutter member 144 opens the manual paper feed opening 143 and the opening and closing guide plate 110 is ready to guide a sheet of paper to be fed manually as shown in FIG. 9. Thereafter, after the passage of a predetermined period of time, for example, 500 msec, in step S8, the shutter switching solenoid 150 is turned OFF into the state shown in FIG. 10.

As a result, in step S9, the shutter member 144 is open, and a single sheet of paper 5 is fed (inserted) into the manual paper feed opening 143 from the single-sheet paper feed tray 141, so that in step S10, the printing part entrance sensor 202 (FIG. 4) of the conveyor belt 31 turns ON. Thereafter, in step S11, an image is formed on the sheet of paper 5, which is fed based on the detection timing of the image registration sensor 203 (FIG. 4). When the printing part entrance sensor 202 detects passage of the trailing edge of the sheet of paper 5 (that is, when the printing part entrance sensor 202 turns OFF) in step S12, in step S13, the opening and closing guide plate solenoid 113 is turned OFF. Meanwhile, in step S14, the sheet of paper 5 having the image formed thereon is output onto, for example, the straight paper output tray 181.

Figure 15:
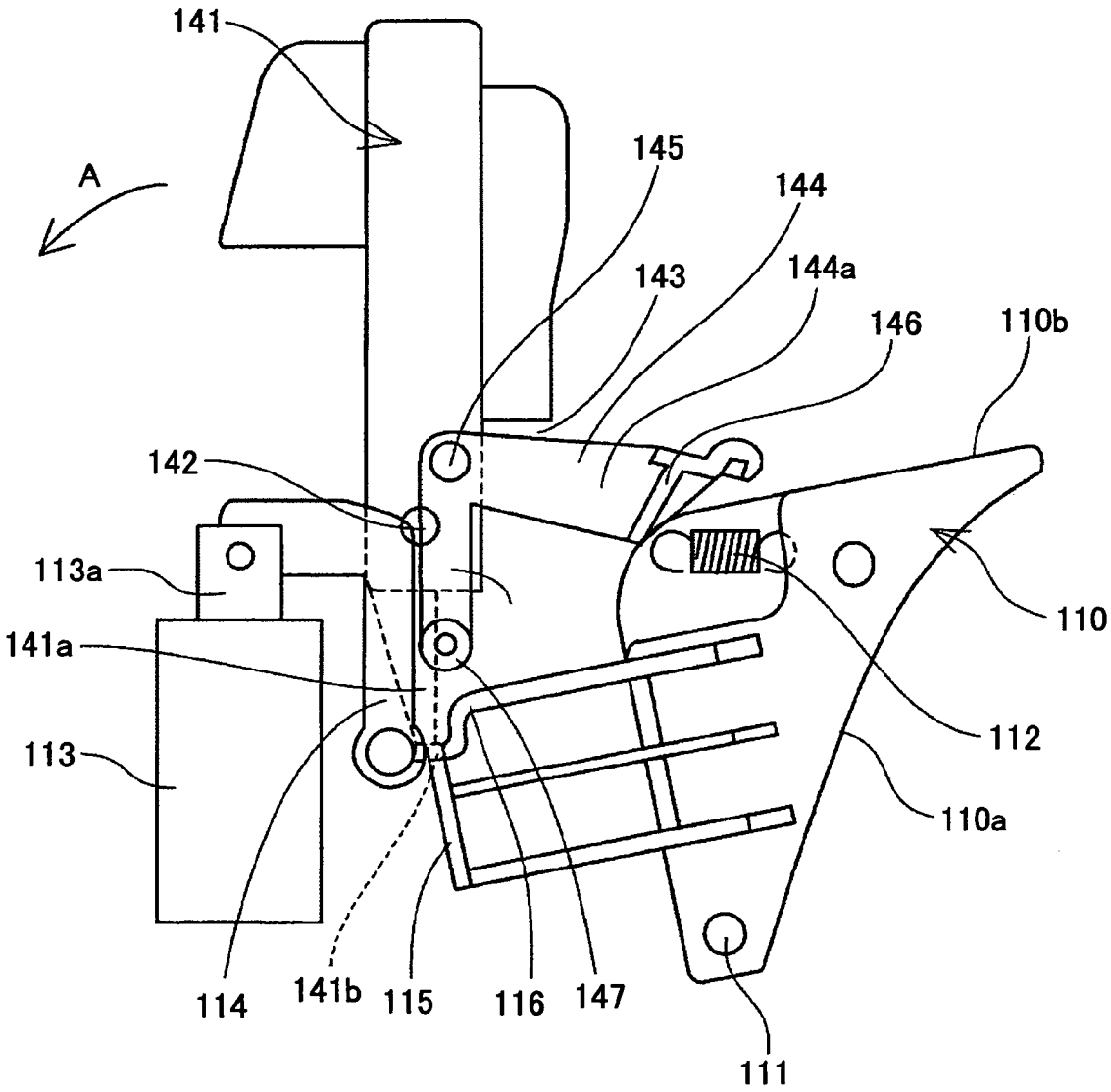
FIG. 15 is a side view of the single-sheet manual paper feed part for illustrating another configuration thereof according to the first embodiment of the present invention.
Figure 16:
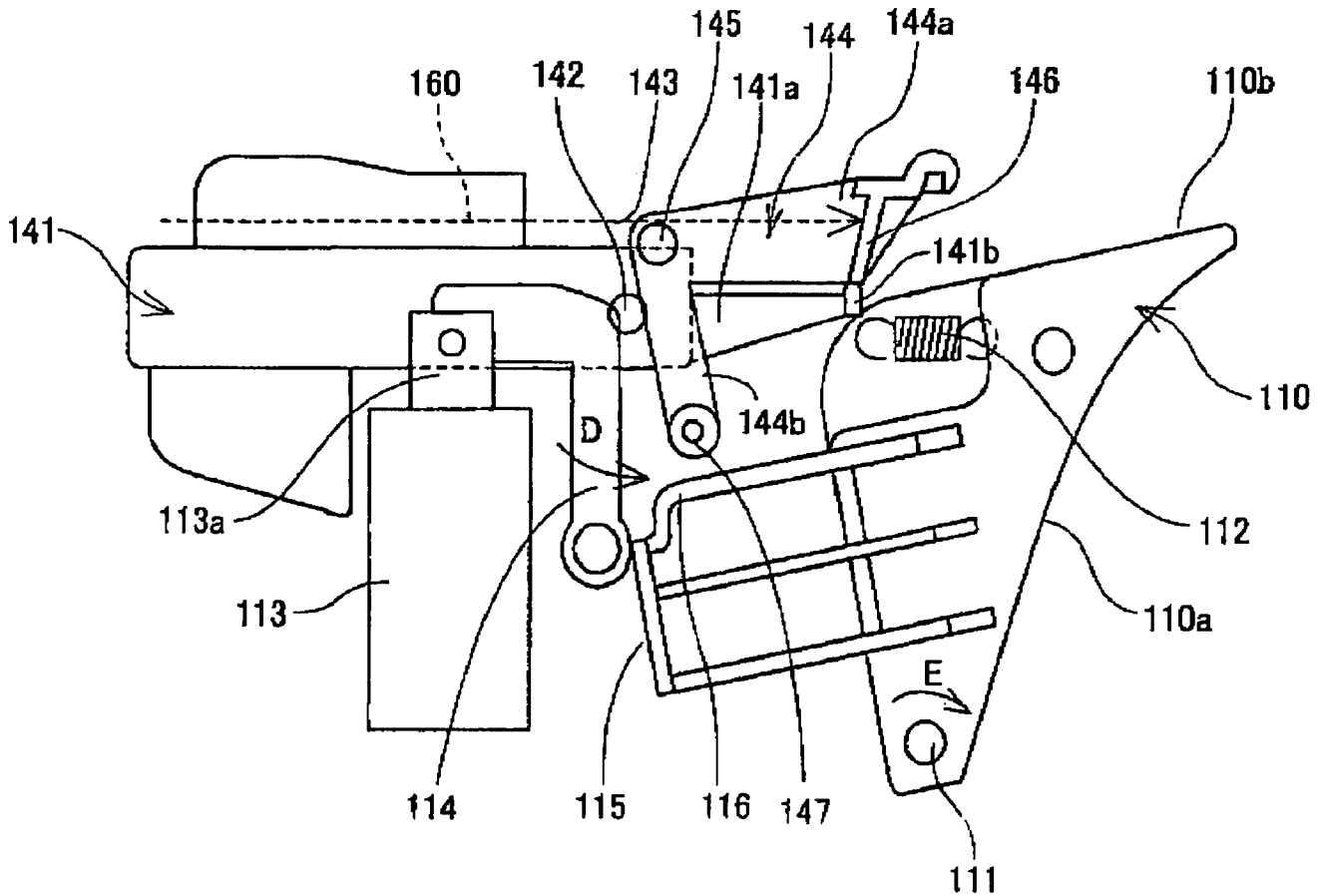
FIG. 16 is a side view of the single-sheet manual paper feed part of FIG. 15 where the single-sheet manual paper feed tray is open according to the first embodiment of the present invention.
Figure 17:
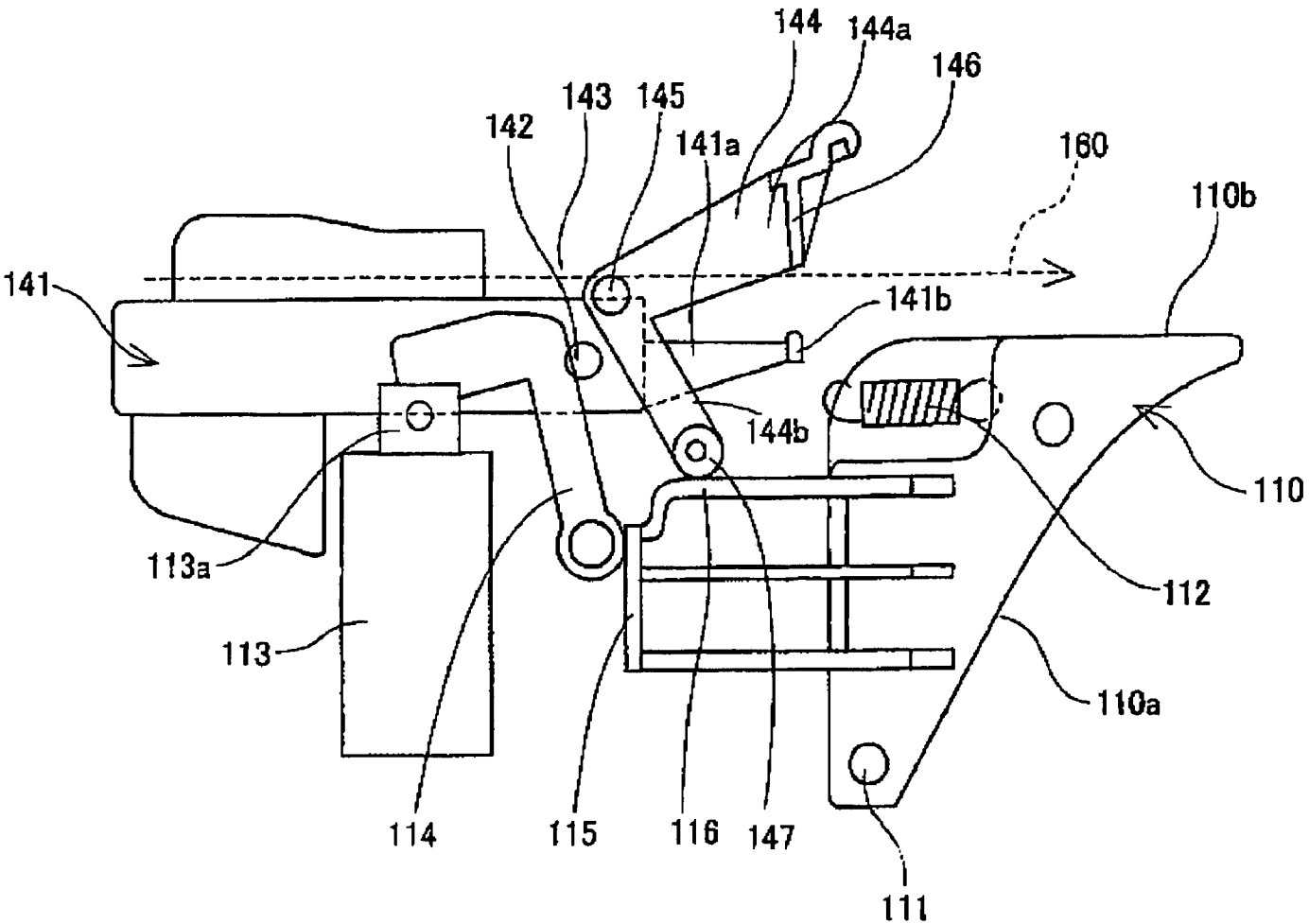
FIG. 17 is a side view of the single-sheet manual paper feed part of FIG. 15 where the shutter member is open according to the first embodiment of the present invention.

Next, a description is given, with reference to FIGS. 15 through 17, of another configuration of the single-sheet manual paper feed part according to this embodiment. FIGS. 15 through 17 are side views of the single-sheet manual paper feed part for illustrating its different conditions.

According to this configuration, the above-described shutter switching solenoid 150 is omitted. The single-sheet manual paper feed tray 141 is pulled down and open so that the arm part 144*b* of the shutter member 144 engages the opening and closing guide plate 110, thereby switching the position of the shutter member 144 to where the shutter member 144 is interlocked with swinging of the opening and closing guide plate 110. That is, the single-sheet manual paper feed tray 141 forms a switch part configured to switch the shutter member 144 between a position where the shutter member 144 is interlocked with the opening and closing guide plate 110 and a position where the shutter member 144 is not interlocked with the opening and closing guide plate 110.

Specifically, as shown in FIG. 15, a swing arm 141*a* is formed integrally with the single-sheet manual paper feed tray 141 at its lower end. A projection 141*b* is formed at the lower end of the swing arm 141*a*. As a result, as shown in FIG. 16, when the single-sheet manual paper feed tray 141 is pulled down and open, the projection 141*b* of the swing arm 141*a* pushes up the arm part 144*a* of the shutter member 144, so that the arm part 144*b* moves to a position where the arm part 144*b* engages the engagement part 116 of the opening and closing guide plate 110.

As a result, by driving the opening and closing guide plate solenoid 113 to cause the opening and closing guide plate 110 to swing as shown in FIG. 16, the engagement roller 147 of the shutter member 144 engages the engagement part 116 of the opening and closing guide plate 110, and the shutter member 144 is interlocked with swinging of the opening and closing guide plate 110 so as to swing up to the OPEN position as shown in FIG. 17. As a result, as shown in FIG. 17, the manual paper feed opening 143 from the single-sheet manual paper feed tray 141 is opened, so that the single-sheet manual paper feed path 160 is opened to allow single-sheet manual paper feeding.

Figure 18:
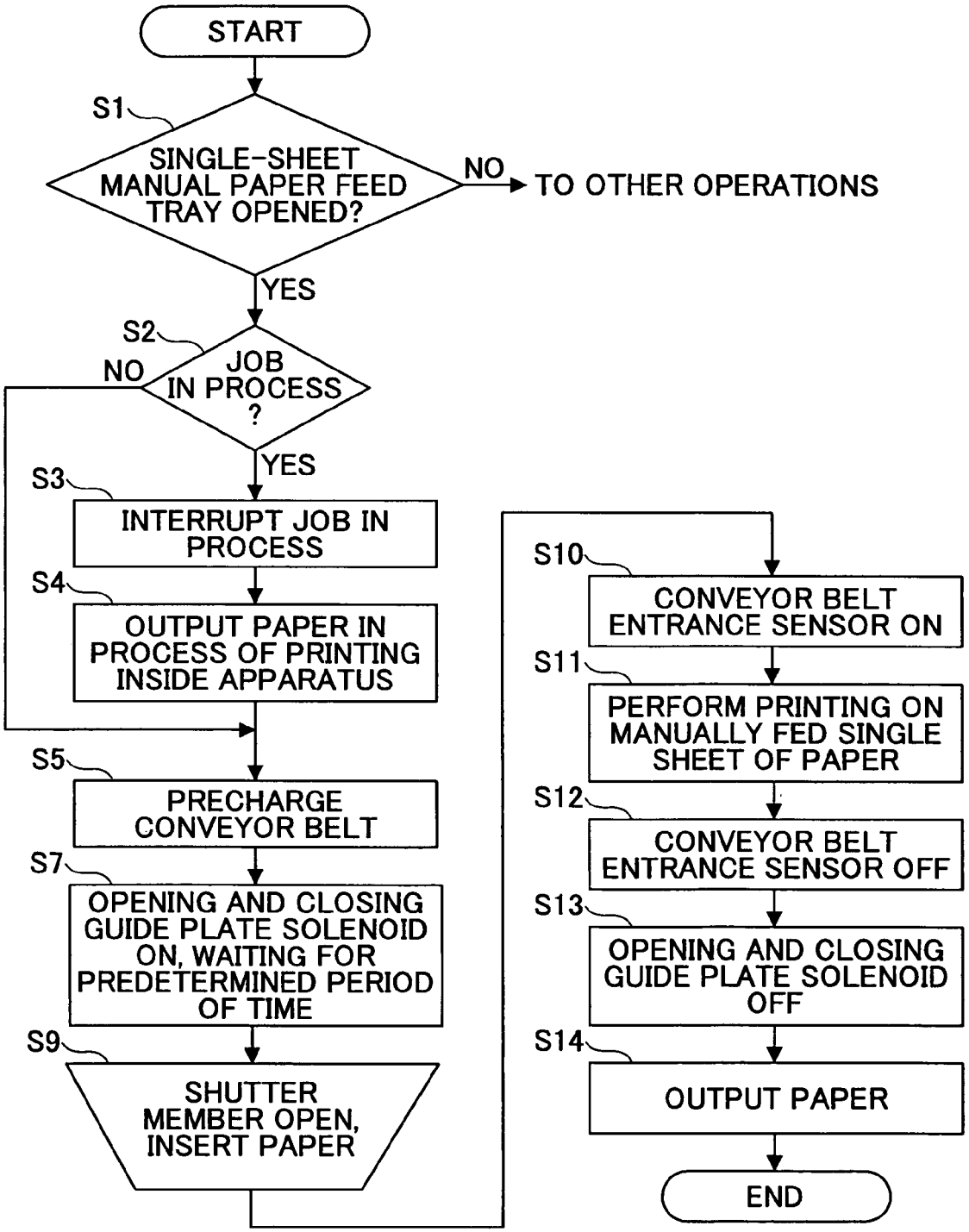
FIG. 18 is a flowchart showing another operation of the control part at the time of single-sheet manual paper feeding according to the first embodiment of the present invention.

FIG. 18 is a flowchart showing an operation performed by the control part 300 in the case of this configuration. The operation of FIG. 18 is different from that of FIG. 14 only in that the ON-OFF control of the shutter switching solenoid 150 (steps S6 and S8) of FIG. 14 is omitted in FIG. 18, and is the same as that of FIG. 14 in the rest of the operation. Accordingly, a description of the operation of FIG. 18 is omitted.

Thus, a shutter member may be switched between a position where the shutter member is not interlocked with an opening and closing guide member and a position where the shutter member is interlocked with an opening and closing guide member by opening and closing of a single-sheet manual paper feed tray. This eliminates a need for an electric drive part such as a solenoid, thus achieving a simpler configuration.

Thus, according to one embodiment of the present invention, an image forming apparatus has a shutter member that opens and closes the feed opening of a manual feed part. Accordingly, even when the manual feed part is ready to perform manual feeding, if a recording medium is remaining inside the apparatus, manual feeding of a recording medium from the manual feed part is prevented by keeping the shutter member closed, so that it is possible to prevent occurrence of a jam.

Next, a description is given of an image forming apparatus according to a second embodiment of the present invention.

In the second embodiment, the same elements as those of the first embodiment are referred to by the same numerals, and a description thereof is omitted.

Figure 19:
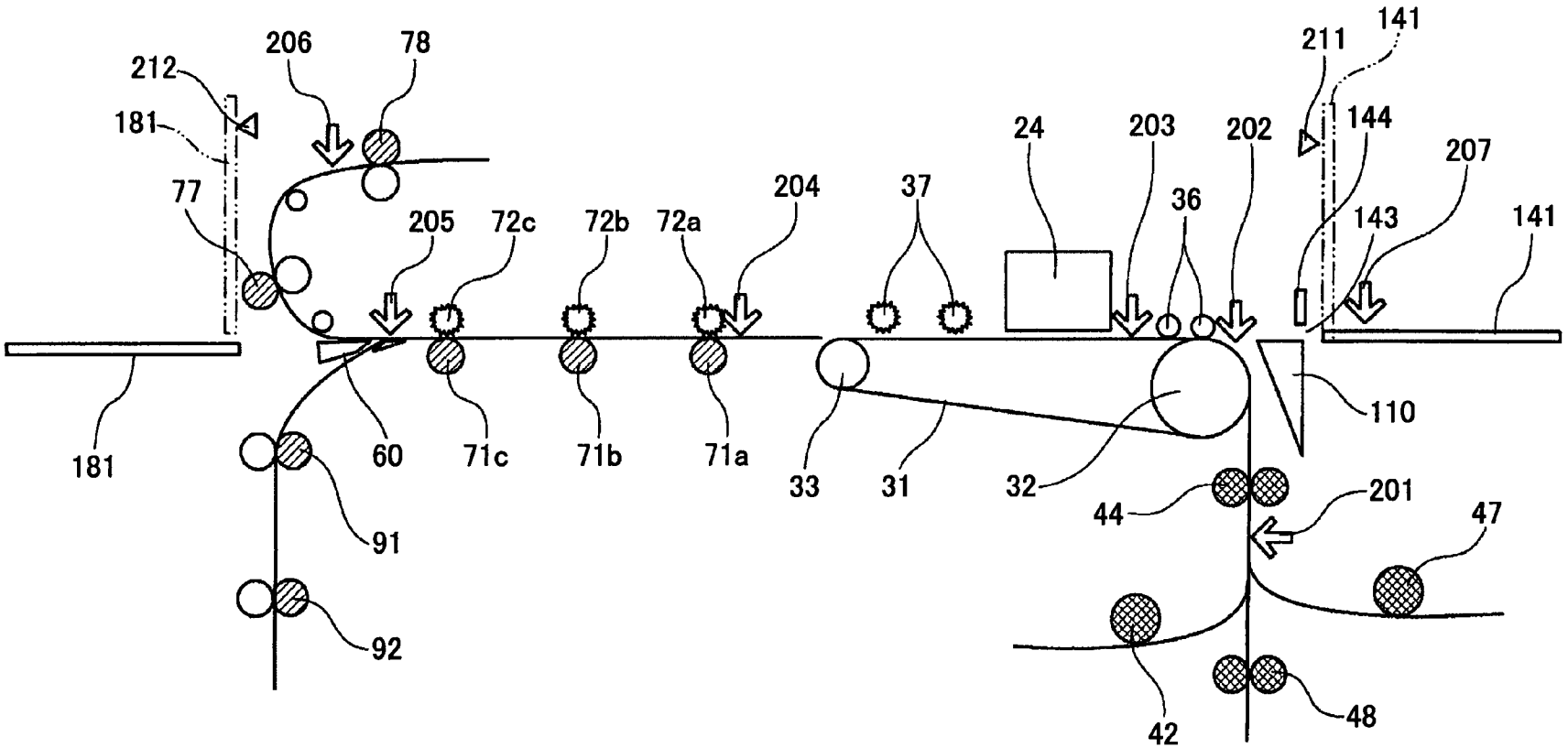
FIG. 19 is a diagram for illustrating paper conveyance paths relating to manual paper feeding of an image forming apparatus according to a second embodiment of the present invention.

The image forming apparatus of the second embodiment has the same configuration as the image forming apparatus of the first embodiment except that the image forming apparatus of the second embodiment further includes a manual feed paper presence/absence sensor 207 for detecting (the presence or absence of) the sheet of paper 5 set on the single-sheet manual paper feed tray 141 as shown in FIG. 19. FIG. 19 is a diagram for illustrating paper conveyance paths relating to manual paper feeding of the image forming apparatus according to the second embodiment.

Accordingly, referring back to FIG. 13, the sensors 326 also include the manual feed paper presence/absence sensor 207, so that a detection signal from the manual feed paper presence/absence sensor 207 is also input to the main control part 310 of the control part 300 of the image forming apparatus according to the second embodiment.

Figure 20:
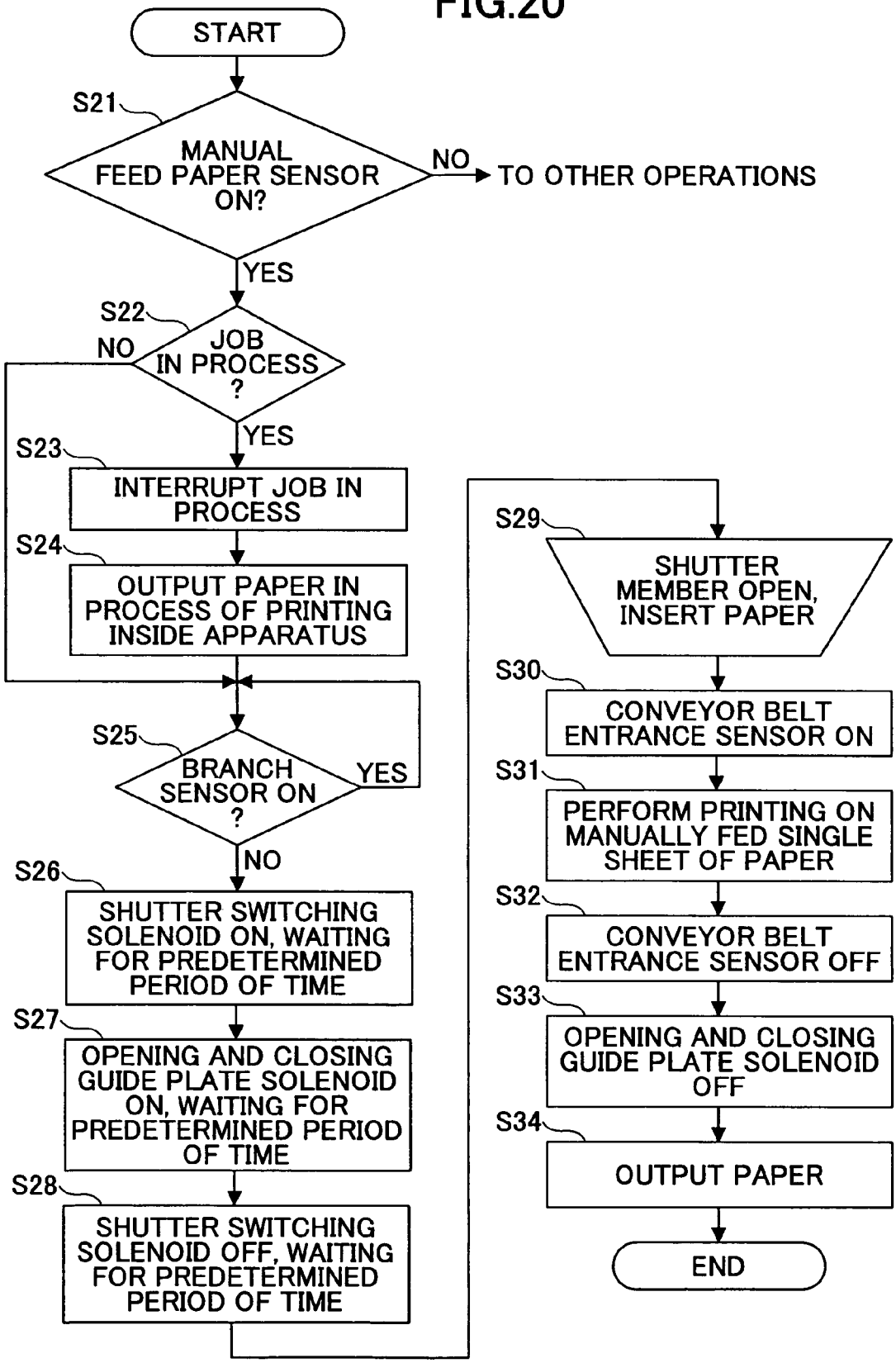
FIG. 20 is a flowchart for illustrating a single-sheet manual paper feed operation by the control part according to the second embodiment of the present invention.

Next, a description is given, with reference to FIG. 20, of a manual paper feed operation in the case of performing single-sheet manual paper feeding using the single-sheet manual paper feed tray 141 according to the second embodiment.

First, in step S21, it is determined whether the sheet of paper 5 is set on the single-sheet manual paper feed tray 141. If the single-sheet manual paper feed tray 141 is opened and the sheet of paper 5 is set on the single-sheet manual paper feed tray 141, so that the detection output of the manual feed paper presence/absence sensor 207 becomes ON (YES in step S21), in step S22, it is determined whether there is a job in process (JOB). If there is a job in process (YES in step S22), it means that there is paper remaining inside the apparatus. Accordingly, in step S23, the job in process is interrupted, and in step S24, an operation is performed to output the paper on which printing is being performed inside the apparatus. At this point, as shown in FIG. 7, the manual paper feed opening 143 is closed by the shutter member 144. Accordingly, no sheet of paper can be fed manually.

Thus, the image forming apparatus may include a part that, when paper is remaining inside the apparatus, prevents paper feeding from a single-sheet manual paper feed tray from being started until outputting of the paper remaining inside the apparatus is completed. This prevents single-sheet paper feeding from being performed while paper is remaining inside the apparatus, thus preventing a paper jam from occurring. Accordingly, it is possible to perform stable single-sheet manual paper feeding.

After the paper of the job in process has been output in step S24, or if there is no job in process (NO in step S22), in step S25, it is determined whether the branch sensor 205 is ON. Waiting is performed until the branch sensor 205 is not ON (OFF). That is, as described below, the branch sensor 205 is configured to be ON if the sheet of paper 5 is output straight onto the straight paper output tray 181 or the output sheet of paper 5 is remaining on the straight paper output tray 181. While the branch sensor 205 is ON, the output sheet of paper 5 is remaining on the straight output paper tray 181. Accordingly, no single-sheet manual paper feeding is performed during this period.

As a result, when paper is output using the straight paper output tray 181 as in the case of single-sheet manual paper feeding, it is possible to use the straight paper output tray 181 for outputting a single sheet of paper. Therefore, it is possible to prevent the sheet of paper 5 on the straight paper output tray 181 from being pushed out thereof by the next sheet of paper, and it is also possible to prevent occurrence of a paper jam due to failure in outputting the sheet of paper 5 properly onto the straight paper output tray 181.

Thus, when paper is neither inside the apparatus main body 1 nor on the straight paper output tray 181 (NO in step S25), in step S26, the shutter switching solenoid 150 is driven (turned ON) into the state shown in FIG. 8, and waiting continues for a predetermined period of time, for example, 500 msec. Thereafter, in step S27, the opening and closing guide plate solenoid 113 is driven (turned ON) so that the shutter member 144 opens the manual paper feed opening 143 (single-sheet manual paper feed path 160) and the opening and closing guide plate 110 is ready to guide a sheet of paper to be fed manually as shown in FIG. 9. Thereafter, after the passage of a predetermined period of time, for example, 500 msec, in step S28, the shutter switching solenoid 150 is turned OFF into the state shown in FIG. 10.

As a result, in step S29, the shutter member 144 is open, and the single sheet of paper 5 is fed (inserted) into the manual paper feed opening 143 from the single-sheet paper feed tray 141. As a result, in step S30, the printing part entrance sensor 202 of the conveyor belt 31 turns ON and an instruction to start printing is given. Thereby, in step S31, an image is formed on the sheet of paper 5, which is fed based on the detection timing of the image registration sensor 203. When the printing part entrance sensor 202 detects passage of the trailing edge of the sheet of paper 5 (that is, when the printing part entrance sensor 202 turns OFF) in step S32, in step S33, the opening and closing guide plate solenoid 113 is turned OFF. Meanwhile, in step S34, the sheet of paper 5 having the image formed thereon is output onto, for example, the straight paper output tray 181.

Figure 21:
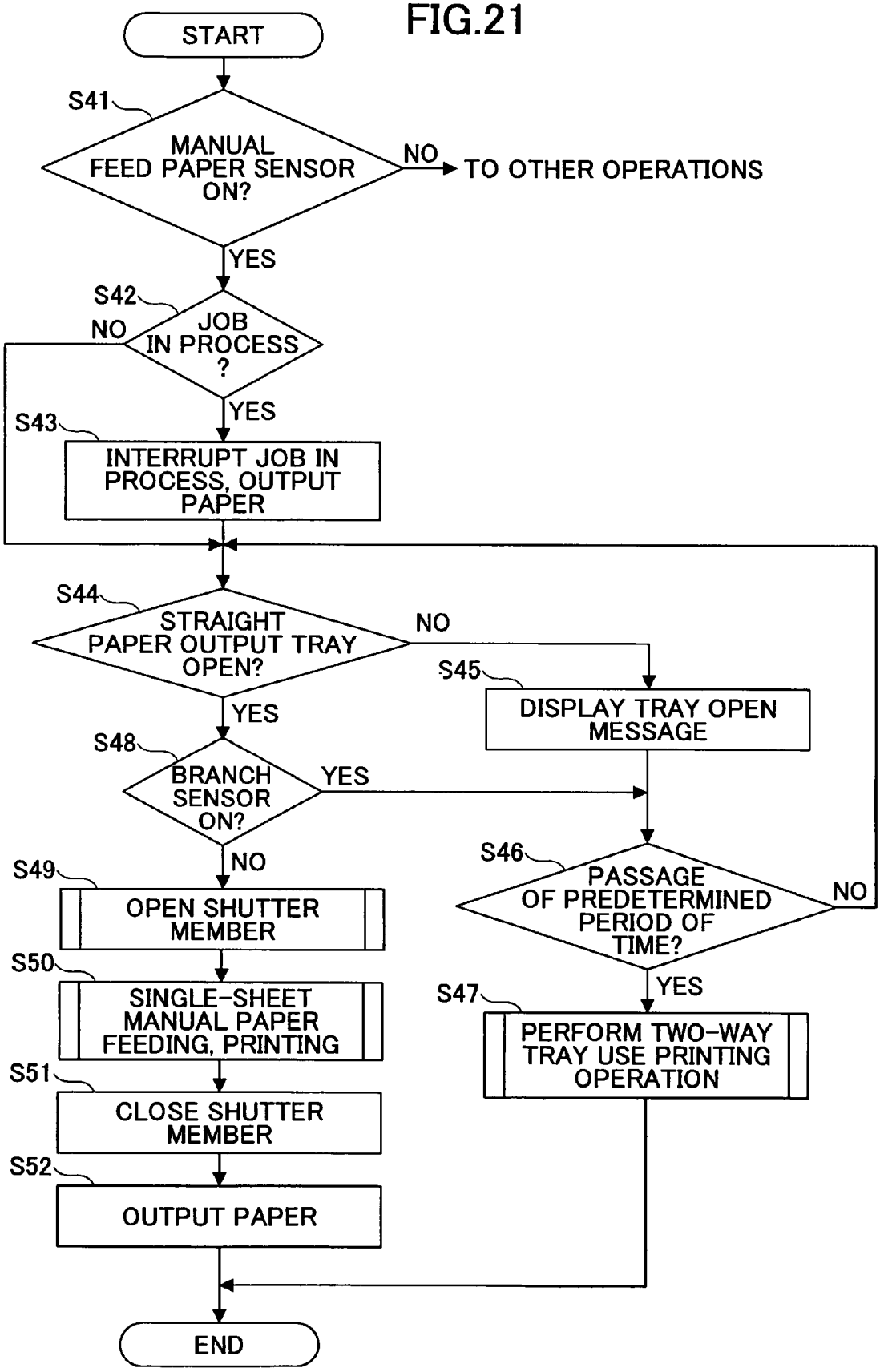
FIG. 21 is a flowchart for illustrating another single-sheet manual paper feed operation by the control part according to the second embodiment of the present invention.

Next, a description is given, with reference to FIG. 21, of another manual paper feed operation in the case of performing single-sheet manual paper feeding using the single-sheet manual paper feed tray 141 according to the second embodiment.

As in the above-described case of FIG. 20, first, in step S41, if the single-sheet manual paper feed tray 141 is opened and the sheet of paper 5 is set on the single-sheet manual paper feed tray 141, so that the detection output of the manual feed paper presence/absence sensor 207 becomes ON (YES in step S41), in step S42, it is determined whether there is a job in process (JOB). If there is a job in process (YES in step S42), it means that there is paper remaining inside the apparatus. Accordingly, in step S43, the job in process is interrupted, and an operation is performed to output the paper on which printing is being performed inside the apparatus.

After step S43 or after NO in step S42, in step S44, the detection output of the paper output tray opening detection sensor 212 is checked, and it is determined whether the straight paper output tray 181 is open (ready to receive output paper). If the straight paper output tray 181 is not open, that is, if the straight paper output tray 181 is closed (NO in step S44), it is not possible to output paper onto the straight paper output tray 181. Accordingly, in step S45, a message (information) encouraging a user to open the straight paper output tray 181 is displayed on the operations and display part 327, and in step S46, it is determined whether a predetermined period of time has passed. These operations are repeated until the predetermined period of time passes. If the straight paper output tray 181 is not open even after the passage of the predetermined period of time (YES in step S46), in step S47, the operation proceeds to a below-described two-way (paper feed/output) tray use printing operation where the single-sheet manual paper feed tray 141 is also used as a paper output tray, and printing by single-sheet manual paper feeding is performed.

That is, if single-sheet manual paper feeding using the straight paper output tray 181 is performed with the straight paper output tray 181 being closed, this results in a paper jam. Accordingly, an operator is encouraged to open the straight paper output tray 181 in order to prevent occurrence of a paper jam. The occurrence of a paper jam is also prevented by not starting single-sheet manual paper feeding before the straight paper output tray 181 is opened.

If single-sheet manual paper feeding is never started unless the straight paper output tray 181 is opened, a user may not know the reason why printing cannot be performed. Accordingly, for user's convenience, if the straight paper output tray 181 is not opened after the passage of a predetermined period of time, the two-way tray use printing operation is performed, and printing by single-sheet manual paper feeding is started.

On the other hand, if the straight paper output tray 181 is open and it is possible to output paper thereonto (YES in step S44), in step S48, as in the above-described case of FIG. 20, it is determined whether the branch sensor 205 is ON. If the branch sensor is ON (YES in step S48), in step S46, it is determined whether a predetermined period of time has passed. These operations are repeated before the passage of the predetermined period of time. If the branch sensor 205 does not become OFF after the passage of the predetermined period of time (YES in step S46), in step S47, the two-way tray use printing operation is performed. In this case also, it is preferable to output a message encouraging a user to remove paper on the straight paper output tray 181 on the operations and display part 327 before entering step S47.

That is, as described above, if single-sheet manual paper feeding is started with paper remaining on the straight paper output tray 181 even when the straight paper output tray 181 is open, the paper on the straight paper output tray 181 may hinder paper output and cause a paper jam. Accordingly, single-sheet manual paper feeding cannot be started as long as paper is remaining on the straight paper output tray 181. However, printing by single-sheet manual paper feeding can never be started if waiting continues. Accordingly, for user's convenience, the two-way tray use printing operation is started after the passage of a predetermined period of time.

If the branch sensor 205 is OFF so that it is possible to output paper onto the straight paper output tray 181 (NO in step S48), the shutter member 144 closing a conveyance path from the single-sheet manual paper feed tray 141 is opened in step S49, an image is formed on the manually fed single sheet of paper 5 in step S50, the shutter member 144 is closed in step S51, and the sheet of paper 5 is output onto the straight paper output tray 181 in step S52 as in steps S26 through S34 of the above-described case of FIG. 20.

Figure 22:
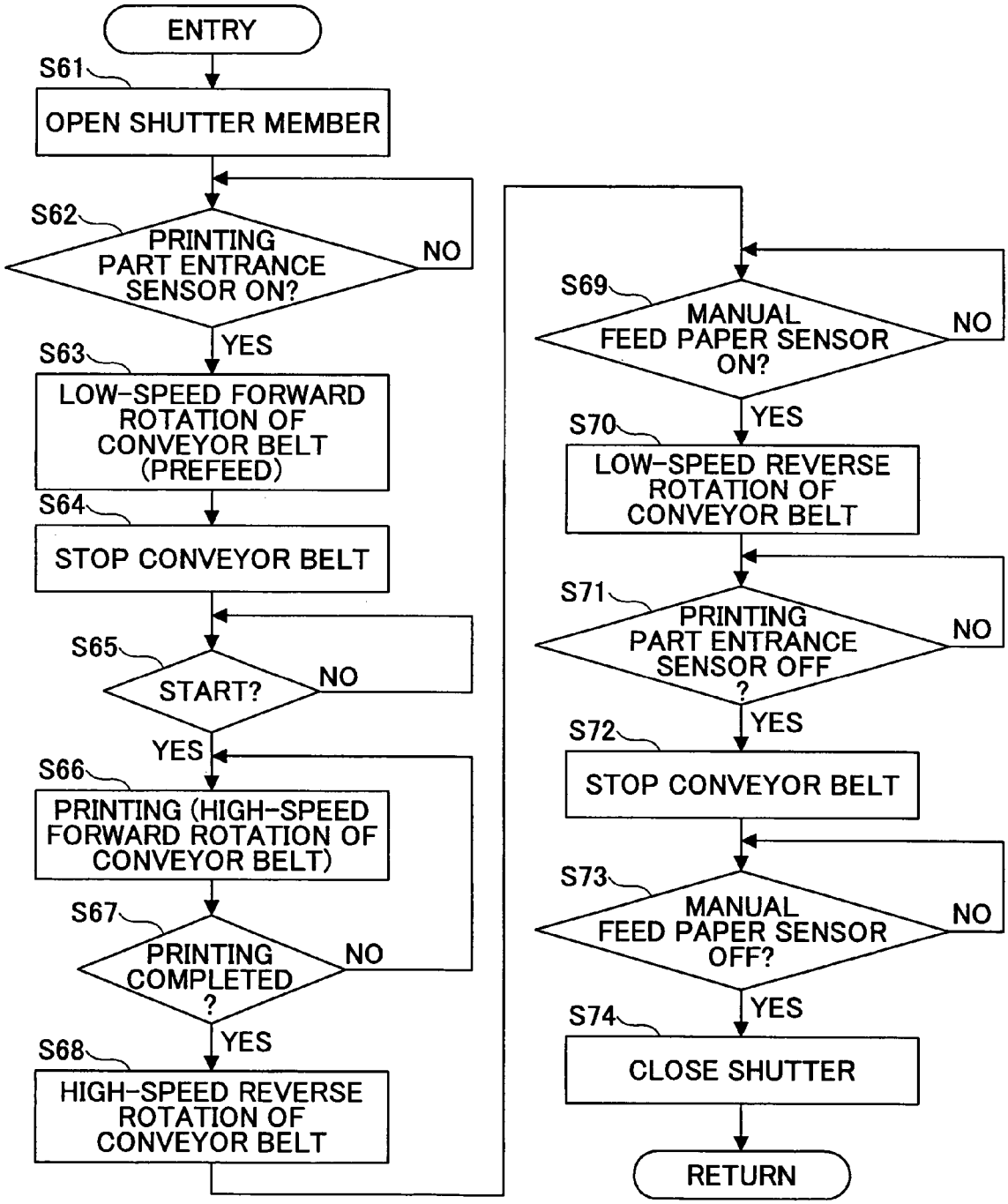
FIG. 22 is a flowchart for illustrating a two-way (paper feed/output) tray use printing operation in the single-sheet manual paper feed operation of FIG. 21 according to the second embodiment of the present invention.

Next, a description is given, with reference to FIG. 22, of the two-way (paper feed/output) tray use printing operation.

In this operation, first, in step S61, the shutter member 144 is opened so as to open the single-sheet manual paper feed path 160 from the single-sheet manual paper feed tray 141. Then, in step S62, it is determined whether the printing part entrance sensor 202 is ON, that is, whether the sheet of paper 5 is inserted (fed) from the single-sheet manual paper feed tray 141. If the sheet of paper 5 is inserted from the single-sheet manual paper feed tray 141 and the printing part entrance sensor 202 turns ON (YES in step S62), in step S63, the conveyor belt 31 is rotated at low speed in the forward direction to prefeed the inserted sheet of paper 5 in the paper conveyance direction or sub scanning direction. In step S64, when the sheet of paper 5 is prefed by a predetermined amount, the conveyor belt 31 is stopped.

In step S65, it is determined whether an instruction to perform printing from the operations and display part 327 or a command to start printing from an external host is received. If an instruction to perform printing from the operations and display part 327 or a command to start printing from an external host is received (YES in step S65), in step S66, as described above, a required image is formed on the sheet of paper 5 by the recording heads 24 while the sheet of paper 5 is being conveyed intermittently by the conveyor belt 31. At this time, the conveyor belt 31 is rotated in the forward direction at a speed of normal printing time (high speed).

Then, in step S67, it is determined whether printing on the sheet of paper 5 is completed. If printing on the sheet of paper 5 is completed (YES in step S67), in step S68, the conveyor belt 31 is rotated at high speed in the reverse (opposite) direction so as to start conveying the sheet of paper 5, on which printing has been performed, in such a direction as to return the sheet of paper 5 to the single-sheet manual paper feed tray 141. Then, in step S69, it is determined whether the manual feed paper presence/absence sensor 207 is ON, that is, whether the leading edge of the sheet of paper 5 in the direction opposite to the sub scanning direction has been returned onto the single-sheet manual paper feed tray 141. When the manual feed paper presence/absence sensor 207 turns ON (YES in step S69), in step S70, the conveyor belt 31 is rotated at low speed in the reverse direction so as to reduce speed at which the sheet of paper 5 is conveyed and output. Then, in step S71, it is determined whether the printing part entrance sensor 202 is OFF, that is, whether the trailing edge of the sheet of paper 5 has passed the conveyor belt 31. When the printing part entrance sensor 202 turns OFF (YES in step S71), in step S72, the conveyor belt 31 is stopped. Then, in step S73, it is determined whether the manual feed paper presence/absence sensor 207 is OFF. When the manual feed paper presence/absence sensor 207 turns OFF (YES in step S73), in step S74, the shutter member 144 is closed so as to close the single-sheet manual paper feed path 160.

Thus, in the case of feeding paper from a single-sheet manual paper feed part and outputting the paper after image formation onto the single-sheet manual paper feed part, a feed speed (rate) at the time of starting to feed paper from the single-sheet manual paper feed part and a feed speed (rate) at the time of outputting the paper onto the single-sheet manual paper feed part may be lower than a feed speed (rate) at the time of forming an image on the paper. This makes it possible to draw in paper from and output paper onto the single-sheet manual paper feed part slowly.

Thus, according to one embodiment of the present invention, an image forming apparatus may include a part that prevents, when a recording medium is remaining inside the apparatus main body, feeding from a single-sheet manual feed part from being started until output of the recording medium remaining inside the main body is completed. As a result, single-sheet manual feeding is not performed while the recording medium is remaining inside the apparatus main body, so that no jam is caused. Accordingly, it is possible to perform stable single-sheet manual feeding.

Further, according to one embodiment of the present invention, an image forming apparatus may include an openable and closable straight output tray onto which a recording medium fed from a single-sheet manual feed part is output straight, and a part that outputs, in a case of performing feeding from the single-sheet manual feed part, information encouraging an operation to open the straight output tray to a position where the recording medium fed from the single-sheet manual feed part is outputtable onto the straight output tray. As a result, single-sheet manual feeding is not performed while outputting onto the straight output tray is not performable, so that no jam is caused. Accordingly, it is possible to perform stable single-sheet manual feeding.

Further, according to one embodiment of the present invention, in an image forming apparatus, when a recording medium is fed from a single-sheet manual feed part, and is output onto the single-sheet manual feed part after an image is formed on the recording medium, a feed speed at the time of starting to feed the recording medium from the single-sheet manual feed part and a feed speed at the time of outputting the recording medium onto the single-sheet manual feed part may be lower than a feed speed at the time of forming the image on the recording medium. Accordingly, it is possible to prevent the recording medium from flying out of the single-sheet manual feed part when the recording medium is output.

Further, according to one embodiment of the present invention, an image forming apparatus may include an openable and closable straight output tray onto which a recording medium fed from a single-sheet manual feed part is output straight. When the recording medium is fed from the single-sheet manual feed part and an image is formed on the recording medium fed from the single-sheet manual feed part, the recording medium is output onto the straight output tray when the straight output tray is in a position where the recording medium fed from the single-sheet manual feed part is outputtable onto the straight output tray, and the recording medium is output onto the single-sheet manual feed part when the straight output tray is in a position where the recording medium fed from the single-sheet manual feed part cannot be output onto the straight output tray. As a result, single-sheet manual feeding is not performed while outputting onto the straight output tray is not performable, so that no jam is caused. Accordingly, it is possible to perform stable single-sheet manual feeding, and it is also possible to perform single-sheet manual feeding quickly The present invention is not limited to the specifically disclosed embodiments, and variations and modifications may be made without departing from the scope of the present invention.

The present application is based on Japanese Priority Patent Application Nos. 2004-361906 and 2004-361918, both filed on Dec. 14, 2004, the entire contents of which are hereby incorporated by reference.

What is claimed is:

1. An image forming apparatus, comprising:

an image forming part configured to form an image on a recording medium;

a feed part for feeding the recording medium;

a manual feed part for manually feeding the recording medium;

a shutter member configured to open and close a manual feed opening from the manual feed part; and a swingable opening and closing guide member for providing slackness to the recording medium in a conveyance path of the recording medium from the feed part to the image forming part, wherein the shutter member is provided so as to be swingable, the manual feed opening is disposed on a downstream side of the swingable opening and closing guide member, swinging of the swingable opening and closing guide member is interlocked with opening and closing of the shutter member, and the shutter member is provided so as to be switchable between a first position where the shutter member is prevented from being interlocked with the swingable opening and closing guide member and a second position where the shutter member is interlocked with the swingable opening and closing guide member.

2. The image forming apparatus as claimed in claim 1, further comprising:

a switch part configured to displace the shutter member from the first position to the second position.

3. The image forming apparatus as claimed in claim 2, wherein the switch part comprises an electric drive part.

4. The image farming apparatus as claimed in claim 2, wherein the switch part comprises a tray of the manual feed part, the tray being attached to a main body of the image forming apparatus so as to be openable and closable with respect thereto.

5. The image forming apparatus as claimed in claim 1, wherein the opening and closing guide member guides the recording medium fed from the manual feed part.

6. The image forming apparatus as claimed in claim 1, wherein the shutter member comprises:

an inclination part extending upward at an angle to a direction in which the recording medium is fed.

7. The image forming apparatus as claimed in claim 1, wherein if the recording medium is remaining inside the image forming apparatus when the manual feed part is in a position where the manual feed part is ready to perform manual feeding, the shutter member is kept in a position where the shutter member is closed until outputting of the recording medium is completed.

8. An image forming apparatus, comprising:

a single-sheet manual feed part for manually feeding a recording medium one sheet at a time;

a part configured to prevent, when the recording medium is remaining inside a main body of the image forming apparatus, the feeding from the single-sheet manual feed part from being started until output of the recording medium remaining inside the main body is completed;

a straight output tray to which the recording medium fed from the single-sheet manual feed part is conveyed straight and output;

a part configured to prevent the feeding from the single-sheet manual feed part from being started when the recording medium output onto the straight output tray is remaining thereon; and a branch detection part configured to detect the recording medium, the branch detection part being provided at a branch part switching output to the straight output tray and output to an output tray onto which the recording medium with an image formed thereon is reversed and output, wherein the branch detection part also serves as a part to detect remaining of the recording medium output onto the straight out tray.

9. The image forming apparatus as claimed in claim 8, further comprising:

a shutter member configured to open and close a conveyance path from the single-sheet manual feed part, wherein the shutter member closes the conveyance path when the single-sheet manual feed part is prevented from starting feeding.

10. An image forming apparatus, comprising:

a single-sheet manual feed part for manually feeding a recording medium one sheet at a time; and a straight output tray onto which the recording medium fed from the single-sheet manual feed part is output straight, the straight output tray being provided so as to be openable and closable, wherein when the recording medium is fed from the single-sheet manual feed part and an image is formed on the recording medium fed from the single-sheet manual feed part, the recording medium is output onto the straight output tray when the straight output tray is in a position where the recording medium fed from the single-sheet manual feed part is outputtable onto the straight output tray, and the recording medium is output onto the single-sheet manual feed part when the straight output tray is in a position where the recording medium fed from the single-sheet manual feed part is prevented from being output onto the straight output tray.

11. The image forming apparatus as claimed in claim 10, further comprising:

a part configured to output, in a case of performing the feeding from the single-sheet manual feed part, information encouraging an operation to open the straight output tray to a position where the recording medium fed from the single-sheet manual feed part is outputtable onto the straight output tray.

12. The image forming apparatus as claimed in claim 11, further comprising:

a shutter member configured to open and close a conveyance path from the single-sheet manual feed part, wherein the shutter member opens the conveyance path when the straight output tray is opened to the position where the recording medium fed from the single-sheet manual feed part is outputtable onto the straight output tray.

13. The image forming apparatus as claimed in claim 10, wherein:

when the recording medium fed from the single-sheet manual feed part is output onto the single-sheet manual feed part after the image is formed on the recording medium, and when the recording medium fed from the single-sheet manual feed part is output onto the single-sheet manual feed part after the image is formed on the recording medium, a feed speed at a time of starting to feed the recording medium from the single-sheet manual feed part and a feed speed at a time of outputting the recording medium onto the single-sheet manual feed part are lower than a feed speed at a time of forming the image on the recording medium.

* * * * *